US005323841A

United States Patent [19]

Wagstaff et al.

[11] Patent Number: 5,323,841

[45] Date of Patent: Jun. 28, 1994

[54] ANNULAR METAL CASTING UNIT

[75] Inventors: Frank E. Wagstaff; Robert B. Wagstaff, both of Veradale; David A. Fort; Richard J. Collins, both of Spokane, all of Wash.

[73] Assignee: Wagstaff, Inc., Spokane, Wash.

[21] Appl. No.: 970,686

[22] Filed: Nov. 4, 1992

[51] Int. Cl.[5] ..... J22D 11/124

[52] U.S. Cl. ..... 164/444

[58] Field of Search ..... 164/444, 486, 487, 483, 164/485, 451, 452, 414

[56] References Cited

U.S. PATENT DOCUMENTS

| | | | |
|---|---|---|---|
| 2,862,265 | 12/1958 | Vaughn et al. | 164/444 |
| 3,665,999 | 5/1972 | Wagstaff et al. | 164/444 |
| 3,688,834 | 9/1972 | Wagstaff et al. | 164/444 |
| 3,739,837 | 6/1973 | Wagstaff et al. | 164/444 |
| 3,749,152 | 7/1973 | Dore et al. | 164/444 |
| 4,598,763 | 7/1986 | Wagstaff et al. | 164/444 |
| 4,693,298 | 9/1987 | Wagstaff | 164/444 |
| 4,709,744 | 12/1987 | Bryson et al. | 164/444 |
| 4,947,925 | 8/1990 | Wagstaff et al. | 164/444 |
| 5,040,595 | 8/1991 | Wagstaff | 164/444 |

*Primary Examiner*—P. Austin Bradley

*Assistant Examiner*—Erik R. Puknys

*Attorney, Agent, or Firm*—Christopher Duffy

[57] ABSTRACT

As a reversal of previous practice, the annular body of the mold in the unit has an annular case at the bottom thereof, rather than at the top thereof. The case is relatively thick axially of the mold, so as to form the greater portion of the axial length of the mold body at the outer periphery thereof; and at the top thereof, the case has an annular plate thereon, which forms a pair of flanges that overhang the case and enable the metal casting unit to be lowered into an aperture of a casting table from above, and supported on top of the table at the flanges. Meanwhile, the case defines the lower end opening of the mold cavity, and the outlet for liquid coolant that is discharged onto the molten metal body as it emerges from the unit. Commonly, the case is monolithic, and also has an annular sump at the top thereof which is covered by the plate to form a chamber for the coolant in the sump. A graphite casting ring may be circumposed about the inner periphery of the case, to form a liner for the upper end portion of the cavity; and a refractory top ring may be circumposed about the upper end opening of the cavity, to form a hot top for the ring.

60 Claims, 10 Drawing Sheets

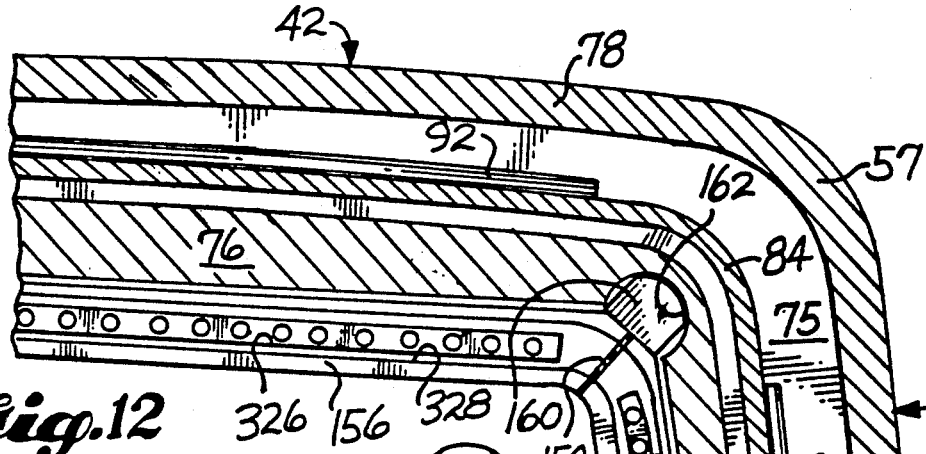
Fig. 12
Fig. 11
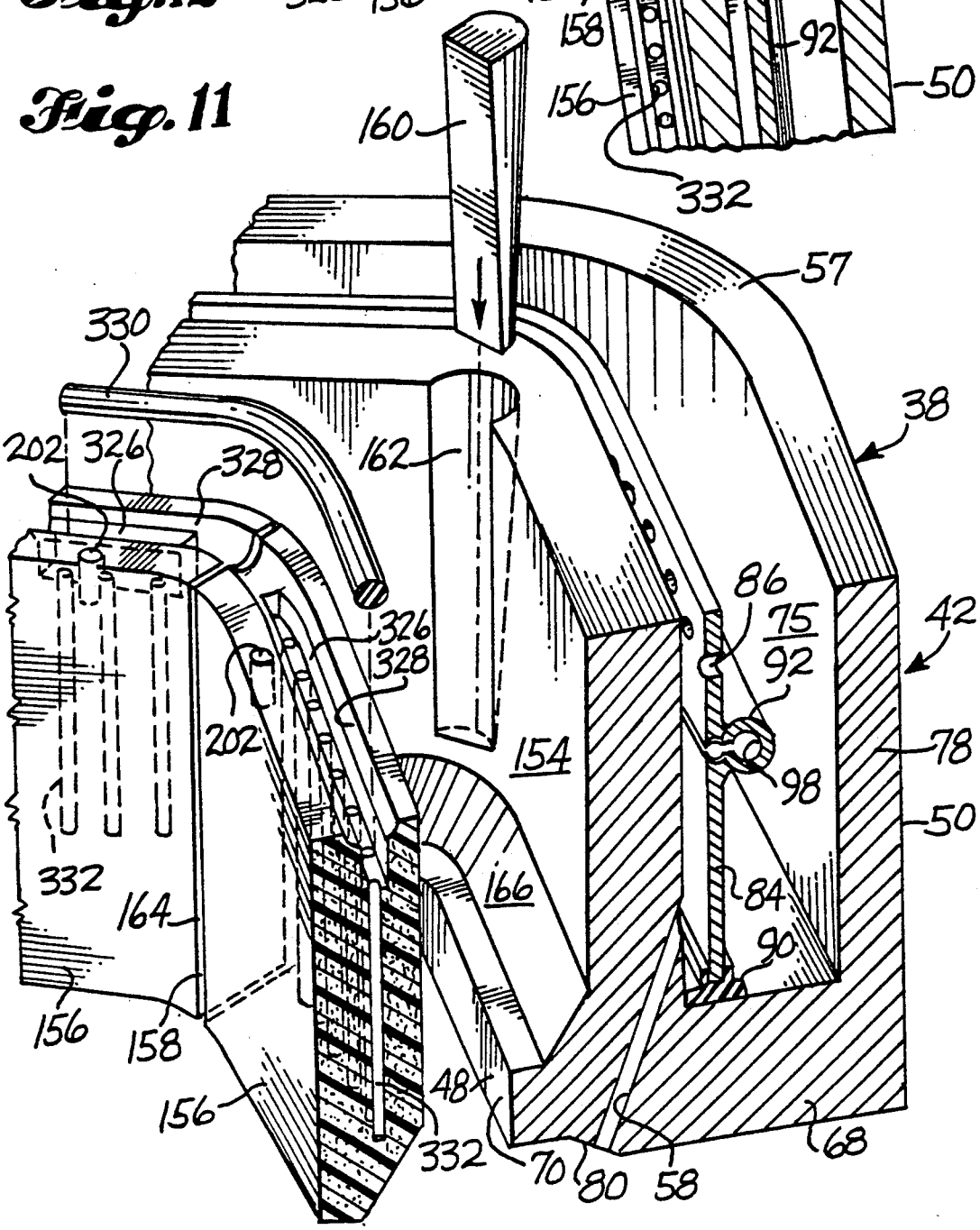

ANNULAR METAL CASTING UNIT

TECHNICAL FIELD

This invention relates to an annular metal casting unit of the type which is operatively supported in an aperture in a metal casting table of a molten metal casting apparatus, so as to form an open ended bore therein through which the molten metal to be cast in the casting operation is poured along a vertical axis of the table and cast into a molten metal body that progressively elongates along the axis as it emerges from the bottom of the bore. During a casting operation with this type, moreover, a liquid coolant is commonly discharged onto the molten metal body as it emerges from the bottom of the bore, to direct cool the metal therein. Commonly too, in a stage preliminary to the casting operation, a stool arranged below the bore, is aligned with the bore on the axis of the table, and vice versa, and then telescopically engaged in the bottom of the bore, so that in the casting operation itself, the stool can be relatively retracted from the bottom of the bore to provide a support for the molten metal body as the body elongates along the axis of the table. Additionally, an oil encompassed annulus of gas may be formed about the molten metal body as it passes through the bore, so as to assist the body in emerging from the bottom of the bore without galling, and/or the liquid coolant to be discharged onto the body, may be infused with a gas which alters the heat transfer characteristics of the coolant on the surface of the body, to vary the rate at which heat is extracted therefrom. See U.S. Pat. Nos. 4,598,763, 4,693,298, 4,947,925, 5,040,595, and 5,119,883 in these latter connections, which were issued by one or more of us. U.S. Pat. No. 4,947,925 also describes how the oil encompassed annulus of gas can be formed about the molten metal body when the bore has an angulated cross sectional outline at the peripheral wall thereof, such as the rectangular cross sectional outline employed in casting sheet ingot.

BACKGROUND ART

For over twenty years, we or one or more of us, have proceeded to develop, construct, and patent a series of annular metal casting units of this type. In addition to the foregoing patents, see also U.S. Pat. Nos. 3,739,837, 4,421,155, and 4,597,432. Each of the units comprised an annular mold having a vertical axis and an annular body circumposed thereabout, which in turn had upper and lower annular ends thereon, relatively inner and outer annular peripheries thereabout, and a bore therethrough, the cavity of which was formed about the axis of the mold and opened into the ends of the mold body, so that the bore of the mold body could form the bore of the table when the unit was supported in the aperture of the table coaxially thereof. The mold body itself comprised a pair of relatively upper and lower casing means which were annular, were circumposed about the axis of the mold, and were superposed on one another so as to have mutually opposing faces thereon which were engaged with one another about the axis to form an annular joint therebetween. The relatively upper casing means in turn comprised an annular case which was relatively thick and substantial axially of the mold, was often monolithic, and had an annular groove in the bottom end thereof. The relatively lower casing means comprised an annular plate which was of course, relatively thin axially of the mold, and was engaged about the bottom end of the case to close the bottom of the groove and form an annular chamber about the axis of the mold. The chamber had an inlet, and it had means such as a series of symmetrically arrayed holes circumposed thereabout adjacent the lower end opening of the cavity, which were connected to the inlet by the chamber and defined an outlet whereby liquid coolant could be charged into the chamber through the inlet, and then discharged through the outlet to direct cool the molten metal body emerging from the cavity at the lower end opening thereof. In the mold, moreover, the case or relatively upper casing member, defined the upper end portion of the mold body at the outer periphery thereof, whereas the plate or relatively lower casing member defined the lower end portion of the mold body at the outer periphery thereof. The case also defined the lower end opening of the cavity at the inner periphery of the mold body, the outlet for the coolant discharge adjacent the lower end opening of the cavity, and the connection between the inlet and the outlet provided by the chamber. In some versions, such as in that shown in U.S. Pat. No. 4,597,432, the metal casting unit was operatively inserted in the aperture of the table from a point therebelow, and therefore, the plate was projected relatively radially outwardly of the axis of the mold from the joint between it and the case, so as to form a flange on the lower end of the mold, at opposite sides thereof, which was operable to engage the bottom of the table so that it could be secured to the table to provide support for the metal casting unit when the unit was inserted in the aperture of the table. In other versions, such as in those shown in U.S. Pat. Nos. 5,040,595 and 5,119,883, the metal casting unit was operatively inserted in the aperture of the table from above the table, and therefore, the flange was formed on the upper end of the case to engage the top of the table and provide support for the unit as it hung in the aperture therebelow.

DISCLOSURE OF THE INVENTION

We have discovered that if (1) the foregoing mode of construction used in the mold bodies of the earlier metal casting units is reversed, (2) the metal casting unit with the reversed construction is inserted in the aperture of the table from above, and (3) the flange thereon is engaged with the top of the table to provide support for the unit as it hangs in the aperture therebelow, then a wealth of new advantages can be achieved vis a vis the old construction. That is, if the aforementioned upper and lower casing members of the mold body are reversed so that what was the relatively upper casing member, is now the relatively lower casing member, and the relatively lower casing member now defines the lower end opening of the cavity at the inner periphery of the mold body, the outlet for the coolant discharge, and the chamber or other connection between the inlet and the outlet, while the relatively upper casing member projects relatively radially outwardly of the axis from the joint between the casing means, to form a flange on the body of the mold which overhangs the relatively lower casing member on opposite sides of the mold, and is operable to engage the top of the table to provide support for the metal casting unit when the unit is inserted in the aperture of the table from above, then a wealth of new advantages can be achieved.

One immediate advantage is that the metal casting unit is more economical to make since while on one hand, the relatively lower casing member of the mold body can be made relatively thick axially of the mold, so as to form the greater portion of the axial length of the mold body at the outer periphery thereof, the relatively upper casing member, on the other hand, can be made relatively thin axially of the mold, so as to constitute simply a plate-like collar for the relatively lower casing member, which is adapted to form a flange on the opposing sides of the mold. In the past, a relatively axially thick casing member, such as the aforementioned case, had to be heavily machined or otherwise fashioned at considerable expense, with considerable loss of material, to form such a flange on the opposing sides of the mold at the upper end thereof. Now the relatively upper casing member simply needs to be given a suitable outline to accomplish that purpose.

Another advantage is that the outline of the cavity at the inner periphery of the relatively upper casing means may substantially correspond to the outline of the cavity at the inner periphery of the relatively lower casing means, transverse the axis of the mold, so that the mold body has a relatively straight bore therethrough axially of the mold; or in the alternative, the inner periphery of the relatively upper casing means may be substantially smaller in outline than the inner periphery of the relatively lower casing means, transverse the axis of the mold, so that the relatively inner peripheral portion of the relatively upper casing means overhangs the relatively lower casing means at the inner periphery of the joint. That is, just as the relatively upper casing means can have an outer peripheral outline adapted to form a flange on the opposing sides of the mold, so too the relatively upper casing means can have an inner peripheral outline adapted to form an overhang at the relatively top opening of the cavity, and neither the flange nor the overhang requires heavy machining or other processing to form the same. Each simply may be accomplished, for example, by forming the relatively upper casing means as a relatively axially thin plate-like collar which is refractory lined at the inner periphery thereof and has the necessary outer and inner peripheral dimensions to form the flange and overhang at the upper end of the mold body.

In fact, the relatively inner peripheral portion of the relatively upper casing means may actually comprise a refractory top ring which is circumposed about the axis of the mold in the upper end opening of the mold body to overhang the cavity at the inner periphery of the joint and form a hot top for the mold. And if that is true, to support the top ring, the relatively upper casing means may simply have an annular shoulder circumposed about the axis of the mold at the inner periphery thereof, and the refractory top ring may be supported on the shoulder to overhang the cavity at the inner periphery of the joint, while the relatively upper casing means have means thereon, such as a plurality of clips, with which to clamp the refractory top ring to the shoulder at the upper end of the mold body.

In fact, as still another advantage, the body of the mold may even have a ring of graphite or the like circumposed about the inner periphery thereof, to form a liner for the cavity at the bore thereof; and in such a case, where the ring of graphite or the like has annular ends, and is circumposed about the axis of the mold at the inner periphery of the joint, the new mode of construction has the further advantage that the ring may be clamped at its ends between the casing members to form a liner for the cavity at the upper end portion thereof. That is, in addition to its many other functions, the relatively upper casing member may also serve as a means for clamping the ring to the relatively lower casing member, for example, in accordance with U.S. Pat. No. 4,947,925 wherein the ring comprises a plurality of individually discrete wall segments of graphite or the like, which are arranged in a plane perpendicular to the axis of the mold and clamped together transversely of the axis to form the ring.

Another advantage is that of the two casing members, the casing member which is better able to withstand the stress of the preliminary stage in the casting procedure when the stool is aligned with and then telescopically engaged in the cavity of the mold body, as well as withstand the stresses generated thereafter in the molding operation itself, is now located at the lower end of the mold body where the various stresses arise. In fact, if desired, the relatively thicker lower casing member can be made monolithic from the inner to the outer periphery thereof, and vice versa, and from the lower end of the mold body to the joint between the casing means, and vice versa, so as to render the mold body even more capable of withstanding the various stresses.

Still another advantage is that the metal casting unit may further comprise means for aligning the mold and the stool with one another on the axis of the mold, and the alignment means may be suspended from the lower end of the mold body, where the mold body is best able to withstand the stresses of the alignment operation. Likewise, the inlet for the liquid coolant may be formed in the lower end of the mold body, where the mold is best able to accommodate it without loss of strength; and in those embodiments of the mold where the outlet for the coolant discharge takes the form of a series of holes which are symmetrically arrayed about the axis of the mold to discharge the coolant about the lower end opening of the cavity, the series of holes may be formed in the relatively lower casing member, again where the mold body is best able to withstand the stresses of the machining operation used in forming these holes.

A still further advantage is that the relatively lower casing member of the mold body may be given an annular sump therein which is circumposed about the axis of the mold at the joint, and interposed in the connection between the inlet and the outlet, and in such a case, the relatively upper casing member can function as a cover for the sump, to form an annular chamber between the inlet and the outlet, for the retention of liquid coolant in the mold body during the casting operation. This was true in the past too, of course, but now the joint between the two casing members is remote from the lower end of the mold body where the mold experiences the greatest stresses.

Other advantages include the fact that when the mold has an annular baffle therein which is circumposed about the axis in the chamber and apertured to meter the liquid coolant between the outer and inner peripheral portions of the chamber, and the baffle has means thereon for infusing the coolant with gas as the coolant flows through the inner peripheral portion of the chamber, then in such a case, the relatively upper casing member may have a source therein for the infusion gas, as well as fluid transmission means suspended therefrom, which are operatively interconnected between the source and the gas infusion means on the baffle, to transport the gas thereto. If desired, moreover, the baffle, the gas infusion means, and the fluid transmission means, may all be suspended from the relatively upper casing member, to form a character modification system for the coolant which can be quickly connected and disconnected with and from the relatively lower casing member across the joint therebetween, when the upper casing member is engaged and disengaged with and from the relatively lower casing member in the assembly and disassembly of the mold body.

Additionally, the metal casting unit may further comprise various devices for monitoring the liquid coolant flow in the connection between the inlet and the outlet, and each such monitoring device may be mounted on the relatively upper casing member, so as to be insertable in the inlet/outlet connection, when an operator of the apparatus wishes to monitor the coolant flow from a point above the table. For example, where the mold body has a chamber in the connection between the inlet and the outlet, the monitoring device may be suspended in the chamber on the relatively upper casing member when the member is engaged with the relatively lower casing member. Or in the alternative, the mold body may have means therein which are operatively interposed between the inlet and the outlet to monitor the coolant flow in the connection therebetween during the casting operation, and the relatively upper casing member may have a port therein for access to the monitoring means. To illustrate, where the mold body has a chamber in the connection between the inlet and the outlet, the monitoring means may include a device for filtering the flow of coolant through the chamber, for the presence of debris therein, and the filtering device may be inserted in the chamber when the relatively upper casing member is engaged with the relatively lower casing member, or the filtering device may be accessible to an operator of the apparatus at the port in the relatively upper casing member, say, when the device needs to be removed for cleaning.

Furthermore, in addition to, or in lieu of, the aforementioned character modification means for the coolant, the relatively upper casing member may have means thereon for indicating a predetermined condition in the connection between the inlet and the outlet, such as a predetermined pressure condition in the connection; and/or means thereon for extracting a portion of the coolant flow from the connection; and/or means thereon for controlling the rate of flow in the connection.

To illustrate, in certain of the presently preferred embodiments of the invention, the mold body has a chamber in the connection between the inlet and the outlet, the relatively upper casing member has a port therein which opens into the chamber, the port has a plug inserted therein, the plug has a filtering device thereon which is suspended in the chamber between the inlet and the outlet, and the plug is removable from the port to remove the filtering device. In this way, the operator of the apparatus can monitor the coolant flow for the presence of debris therein, and in fact extract the debris from the flow when desired. By adding means on the relatively upper casing member for indicating when the debris has accumulated to the extent that the back pressure in the connection is undesirable, the operator may also control the rate of flow in the connection.

The new construction also has the further advantage that where the mold has a source of pressurized fluid thereon, the joint may have a circumferentially extending fluid flow passage provided therein for transmitting the fluid between the faces of the casing means, and the metal casting unit may further comprise means whereby the fluid in the passage is discharged from the mold to a point on the outside thereof for some function in the casting procedure. The function may be one wherein the fluid discharge means are operable to discharge the fluid from the passage to the inner periphery of the joint, for example, for purposes of oiling the bore of the mold body during the casting operation. Or the function may be one wherein the passage is operable to circulate the fluid about the axis of the mold to a plurality of circumferentially spaced sites in the joint, and the fluid discharge means are operable to discharge the fluid from the respective sites, for example, to a plurality of fluid operated devices that are suspended from the mold for use in aligning the mold and stool with one another during the preliminary stage to the casting operation; or to a plurality of gas permeable wall segments which are arrayed about the inner periphery of the mold body to form an annulus of gas thereadjacent. Or two or more functions may be combined. For example, in certain of the presently preferred embodiments of the invention, the joint has a pair of first and second circumferentially extending fluid flow passages therein which are spaced apart from one another transverse the axis of the mold, and the first passage is operable to circulate the fluid about the axis of the mold to a plurality of circumferentially spaced sites in the joint, while the fluid discharge means are operable to discharge the fluid from the respective sites to the inner periphery of the joint through the second passage.

In an example of still another function, the passage is formed at an axially extending step in the joint, lying between a pair of spaced parallel planes transverse the axis of the mold, and the fluid discharge means are operable to discharge the fluid from the passage at the space between the planes before the fluid can enter the cavity at the inner periphery of the joint, for example, to discharge leakage coolant from the joint before the leakage coolant can enter the cavity at the inner periphery of the joint.

Where the fluid discharge means are operable to discharge the fluid from the passage at the inner periphery of the joint, the fluid discharge means sometimes take the form of an annular slit which is circumposed about the axis between the faces of the casing means at the inner periphery of the joint, and accompanied by a ring of porous, fluid permeable material which is interposed in the joint between the passage and the slit to discharge the fluid into the cavity through the slit. Or the fluid discharge means take the form of a ring of porous, fluid permeable material such as graphite, which has annular ends on the body thereof, and is circumposed about the axis at the inner periphery of the joint, with the fluid transmission passage interposed between the annular ends thereof, to discharge the fluid into the cavity through the body thereof. To aid in the discharge of the fluid, the passage may have branches thereof which extend within the body of the ring axially of the mold, to distribute the fluid more fully within the ring.

In certain presently preferred embodiments of the metal casting unit, the opposing faces of the casing means have a pair of surfaces thereon which extend about the axis of the mold opposite an annulus of the joint therebetween, and the surface on the face of one of the casing means has a groove therein which extends about the annulus to form a recess between the bottom of the groove and the surface on the face of the other casing means. The source of pressurized fluid is connected with the bottom portion of the groove, to charge the groove with fluid, but the groove has a closure member seated in the top portion thereof at the joint, to form a circumferentially extending fluid flow passage in the bottom portion of the groove, and at the same time, control the leakage of fluid from the passage. In some embodiments, the closure member comprises a fluid permeable material which is operable to discharge the fluid from the passage at the inner periphery of the joint. In other embodiments, the closure member is a fluid impermeable material, but the groove defining surface portion of the one casing means comprises a fluid permeable material which is operable to discharge the fluid from the passage at the inner periphery of the joint.

Where the relatively lower casing member has an annular sump therein which is circumposed about the axis of the mold at the joint and covered by the relatively upper casing member to form an annular chamber in the body of the mold, the chamber is a source of pressurized fluid in the mold in the sense that the coolant liquid may leak into the joint from the chamber in the direction of the axis of the mold. However, if the joint has an axially extending step therein between the sump and the inner periphery of the joint, and the passage is interposed between the axially extending surfaces of the step, the fluid discharge means may operate to discharge the leakage coolant from the passage to an outlet on the outside of the mold before the leakage coolant can reach the inner periphery of the joint.

All of the fluid discharge versions of the invention have the further advantage that either the source of pressurized fluid, or the outlet for leakage coolant, or both, can be formed on the relatively upper casing member where, again, access to the mold is greatest and the member is the easier to work in the manufacturing process. Preferably, the source of pressurized fluid and/or the outlet are formed on the outer peripheral edge of the flange.

Still another advantage of the new construction is the fact that the table of the apparatus can be swung from the horizontal casting position thereof, to a position more vertically inclined to the horizontal, so as to provide access to the metal casting for purposes of removing it from the apparatus, and in such a case, no oil or other fluid will remain in the casting unit after a casting operation, which might escape into unwanted areas of, or from the casting unit, when the table is swung up and away from the horizontal. Compare this with U.S. Pat. No. 5,033,535 wherein each metal casting unit must be purged of oil at the end of each casting operation.

The new construction may be employed in the context of a mold having a cavity with a quadrilateral or some other angulated outline at the bore thereof, or in the context of one having a cavity with a cylindrical or elliptical outline at the bore thereof.

BRIEF DESCRIPTION OF THE DRAWINGS

The new construction and the advantages of it will be better understood by reference to the accompanying drawings which illustrate a molten metal casting apparatus of the type previously mentioned, but which is constructed in accordance with the invention and has a stool with a swingable table thereabove, and four metal casting units thereon, which incorporate any one of several presently preferred embodiments of the invention to cast metal ingot in sheet form, that is, in a form requiring a substantially rectangular outline at the bore of each cavity therein.

In the drawings:

FIG. 11 is a perspective view of the relatively lower casing member at the corner of the mold when the relatively upper casing member has been removed, but the baffle and gas infusion means left at each side of the corner to illustrate the infrastructure of the mold more fully;

FIG. 12 is a plan view thereafter of the relatively lower casing member at the corner of the mold;

BEST MODE FOR CARRYING OUT THE INVENTION

Figure 1:
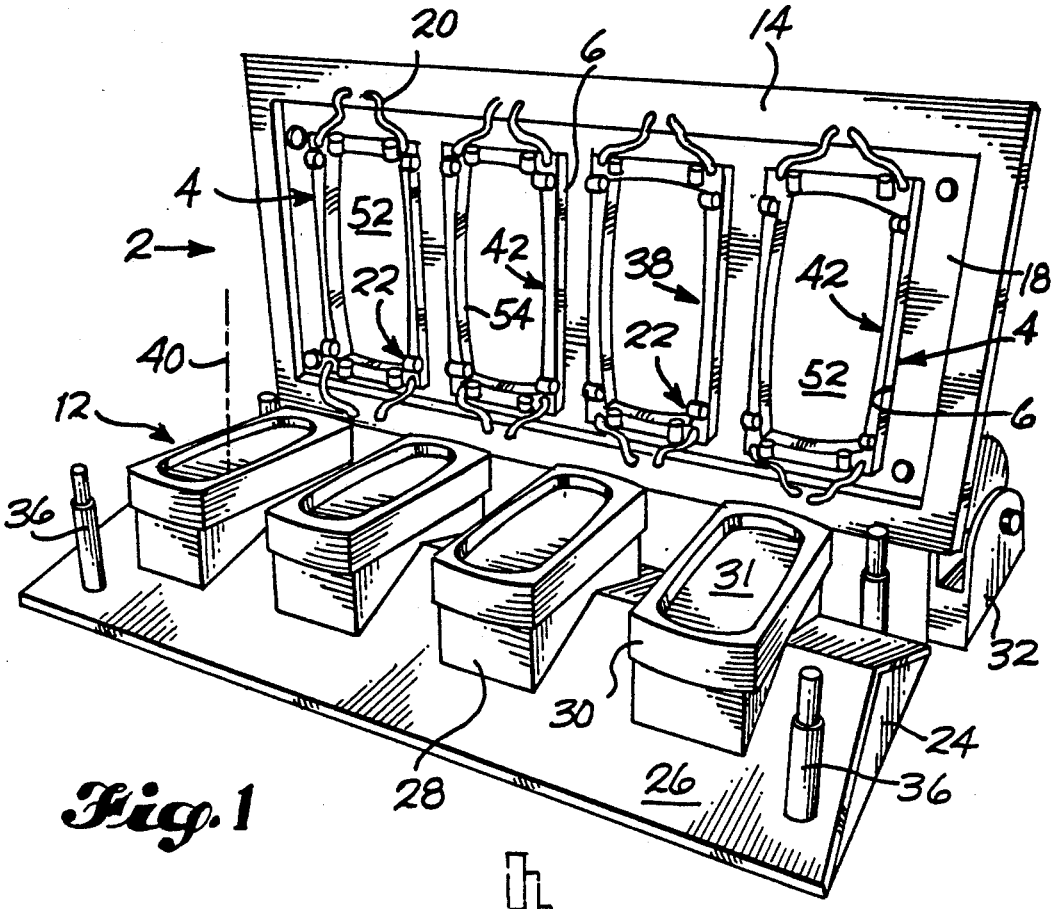
FIG. 1 is a perspective view of the metal casting apparatus, when the table thereof has been swung up and away from the stool for removal of the four castings from the apparatus.
Figure 2:
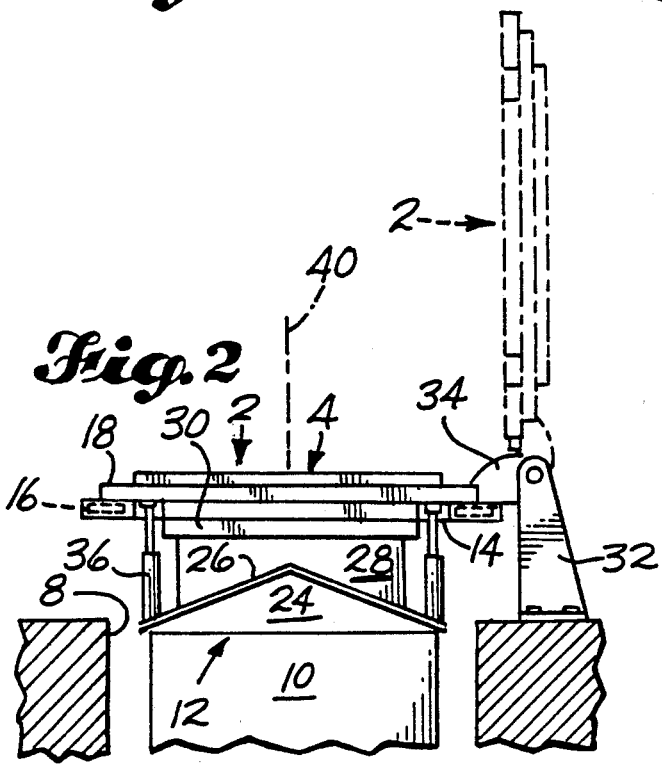
FIG. 2 is an end elevational view of the apparatus when the table has been swung back into a horizontal position over the stool for another casting operation.
Figure 3:
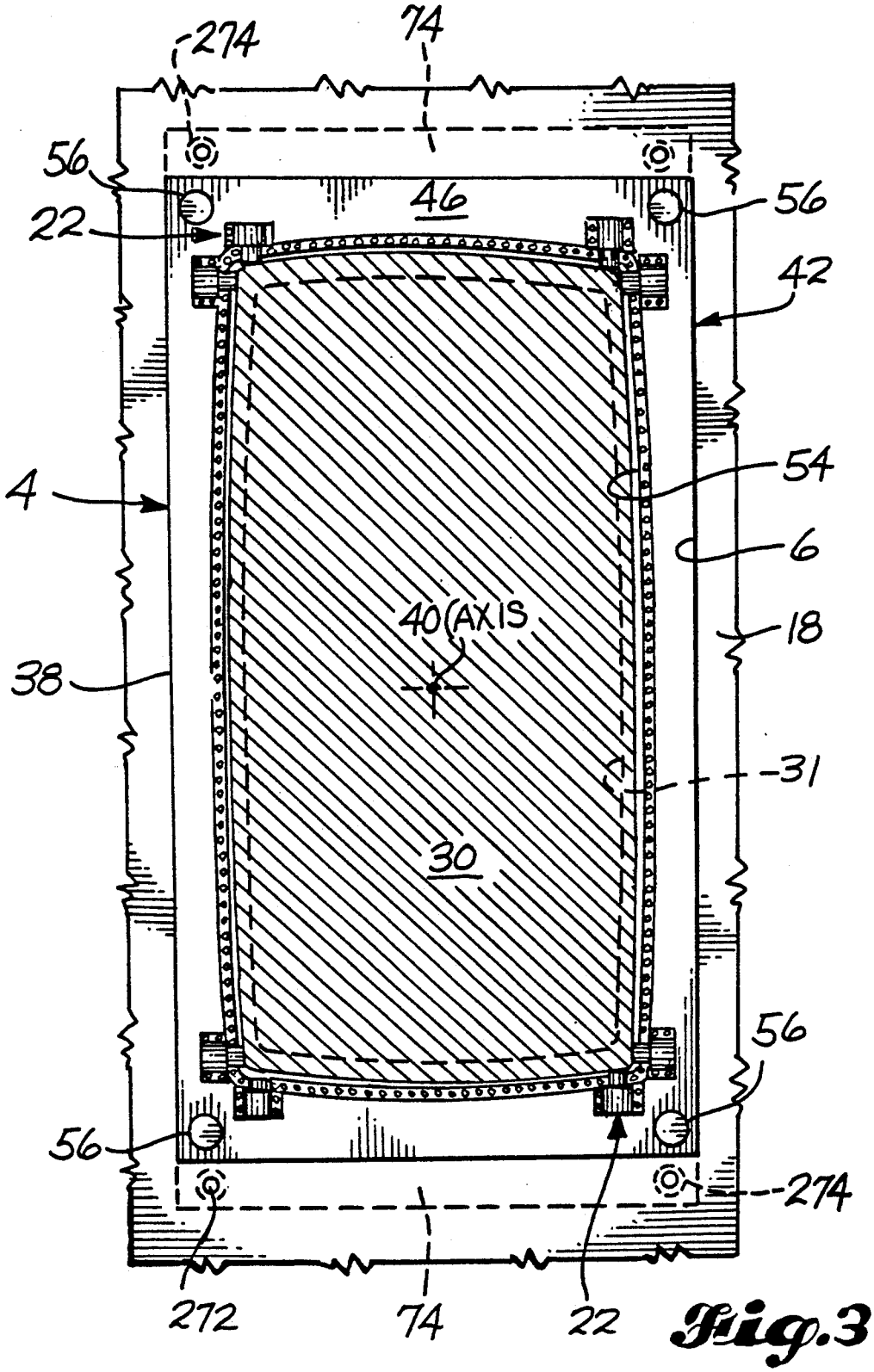
FIG. 3 is a part cross sectional bottom view of the mold in one of the metal casting units on the table when the corresponding cap of the stool is engaged in the bottom of the mold.

Referring firstly to FIGS. 1–3, it will be seen that the metal casting apparatus comprises a metal casting table 2 which is pivotally mounted at one edge of a casting pit 8, and has four annular metal casting units 4 thereon that are operatively supported in an equal number of apertures 6 therein. During the casting operation, the table is positioned over the pit so that the metal casting units are disposed on vertical axes 40. However, when the operator of the apparatus wishes to access the pit for removal of the finished metal castings (not shown) from the pit, the table is swung up and away from the pit, to a position in which it is steeply inclined to the horizontal. See FIG. 1 and the dashed line representation of the table in FIG. 2.

The apparatus also comprises a platen 10 which is reciprocably mounted in the pit, to be raised and lowered in relation to the table; and a stool 12 which is supported on top of the platen to provide a retractable support for the molten metal bodies (not shown) which progressively "drop" from the bottoms of the units 4 during the casting operation. The molten metal bodies progressively elongate along the axes 40 of the units, as the platen and stool are retracted into the pit with the bodies "standing" thereon. Initially, however, before the casting operation is begun, the stool must be telescopically engaged in the bottoms of the units, so as to receive the molten metal for this purpose as it is poured into the units. Moreover, in a separate operation even ahead of that, the stool and units must be aligned with one another on the axes 40, using sets of air cylinders 22 on the bottoms of the units, as shall be explained. As shall also be explained, during the casting operation itself, liquid coolant is commonly discharged onto the molten metal bodies as they emerge from the bottoms of the units, to direct cool the metal in them and aid in their transformation into sheet ingot.

Turning now to the particulars of the respective components in the apparatus, it will be seen that the table comprises an open faced frame 14 which is rectangular in outline and has a liquid coolant jacket 16 therein, which extends circumferentially about the frame to provide a coolant supply for the casting units 4. The units themselves are also generally rectangular in outline, and are supported on a plate 18 that is secured to the top of the frame and has the apertures 6 crosswise thereof. The units are therefore also arranged crosswise of the frame, so that the corners of the units are accessible to pairs of hoses 20 that depend from the jacket. The hoses are connected to the corners of the units at the bottoms thereof, and the sets of air cylinders 22 are suspended from the bottoms of the units, on the opposing ends and sides thereof, adjacent the hose connections therein.

The stool comprises a pedestal 24 which is broad enough to overlie the top of the platen, and has a gable-like cover 26 thereon, the sloping sides of which operate to quickly shed the coolant discharging onto the stool from the casting units during the casting operation, as well as any metal falling on the stool from the units. The cover in turn has a row of stout supports 28 upstanding thereon, which have so-called bottom blocks or caps 30 on the tops thereof, that are adapted to telescopically engage in the bottoms of the casting units, when the units have been aligned with the caps, and vice versa, preliminary to the casting operation. The centers 31 of the caps are recessed, meanwhile, to receive the initial molten metal flow issuing from the casting units, and to aid in the formation of a suitable "butt" on the bottoms of the molten metal bodies as they form and "stand" on the caps.

At the edge of the pit, the table is pivotally mounted on a pair of yoke like stanchions 32 that have a pair of arms 34 extending from the yokes thereof, with the table supported at the outboard ends thereof. When in the horizontal position, the table can be rested on and attached to pairs of posts 36 that are positioned upright at the ends of the stool. The posts are attachable to the table at the plate 18, to enable the stool and table to be interconnected with one another as a "sandwich" which is susceptible in turn to being hoisted from the top of the pit by a crane (not shown) once the table has been detached from the arms of the stanchions. When a casting operation is to be conducted, however, the posts are detached from the plate, and vice versa, so that the stool can retract into the pit with the platen while the table remains supported on the arms of the stanchions.

Referring now to FIGS. 4–16, it will be seen that although the several metal casting units 4 shown therein, are distinct from one another in certain regards, each nevertheless comprises an annular mold 38 which is generally rectangular in outline and has a vertical axis 40 and an annular body 42 of similar outline circumposed thereabout. The mold body in turn has upper and lower rectangular ends 44 and 46 thereon, relatively inner and outer rectangular peripheries 48 and 50 thereabout, and a bore 54 therethrough, the cavity 52 of which is similarly rectangularly outlined. The cavity 52 is formed about the axis 40 of the mold and opens into the ends 44, 46 of the mold body, so as to form an open ended bore for the molten metal when the unit is supported axially upright in the corresponding aperture 6 of the table.

As indicated earlier, the molten metal is poured along the axis of the mold and cast into a molten metal body (not shown) that progressively elongates along the axis as it emerges from the bottom of the bore. Meanwhile, liquid coolant such as water, is commonly discharged onto the molten metal body as it emerges from the bottom of the bore, to direct cool the metal therein. Therefore, to provide for the coolant discharge, the mold body also has inlets 56 in the corners 57 thereof, and means in the form of a series of symmetrically arrayed holes 58 therein, which are circumposed about the axis 40 of the mold adjacent the lower end opening 70 of the cavity, to define an outlet which, as shall be explained, is interconnected with the inlets at 72, so that liquid coolant can be charged into the mold body through the inlets and then discharged from the outlet to direct cool the molten metal body emerging from the bottom of the bore.

Structurally, the mold body 42 comprises a pair of relatively upper and lower casing means 60, 62 which are rectangular, circumposed about the axis 40 of the mold, and superposed on one another so as to have mutually opposing faces thereon which are engaged with one another about the axis to form an annular joint 64 therebetween. The casing means in turn comprise a pair of relatively upper and lower casing members 66, 68 which are rectangular, circumposed about the axis, and engaged with one another at the joint 64 to define the relatively upper and lower end portions of the mold body at the outer periphery 50 thereof, respectively. The relatively lower casing member 68 also defines the lower end opening 70 of the cavity at the inner periphery 48 of the mold body, the outlet holes 58 for the coolant discharge, and the connection 72 between the inlets 56 and the outlet holes. Meanwhile, at the top of the mold, the relatively upper casing member 66 projects relatively radially outwardly of the axis from the joint 64 between the casing means, to form flanges 74 on the rectangular body of the mold which overhang the relatively lower casing member 68 at the opposing ends of the mold, and are operable to engage the top of the table 2 to provide support for the metal casting unit 4 when the unit is lowered into the aperture 6 of the table from above the table.

More particularly, the relatively lower casing member 68 takes the form of an annular case which is relatively thick axially of the mold, so as to form the greater portion of the axial length of the mold body at the outer periphery 50 thereof. The relatively upper casing member 66 takes the form of an annular plate which is relatively thin axially of the mold, so as to constitute little more than a collar for the case, which however, forms the flanges for the mold. The case 68 is also monolithic from the inner 48 to the outer periphery 50 thereof, and vice versa, and from the lower end 46 of the mold body to the joint 64 between the casing means, and vice versa. However, the case 68 has an annular sump 75 therein at the joint, which is circumposed about the axis of the mold and covered by the plate 66 so that the case has relatively inner and outer peripheral walls 76, 78, and an annular chamber 72 therebetween. The respective inlets 56 open into the chamber at the corners 57 of the mold body, and are supplied by the hoses 2 0 from the jacket of the table, there being threading about the respective inlets to cooperate with corresponding threading (not shown) on the ends of the hoses. The respective outlet holes 58 discharge from the chamber into the inner peripheral edge 80 of the mold body at the lower end thereof; and the edge 80 is chamfered to the axis of the mold so that the holes may be sharply downwardly inclined to the axis, yet discharge at right angles to the edge. The height of the series of holes above the lower end 46 of the mold body varies somewhat from one mold to another, however; and in addition to being chamfered, the lower inner peripheral edge 80 of certain molds is rabbeted to accommodate to the variance in the height of the series of holes. The holes themselves are often lined with tubular inserts 82 at the bottoms thereof, to increase the velocity of the discharge from the holes.

Each mold also comprises a coolant character modification system 83 (FIG. 8) which is suspended from the underside of the plate. The system is adapted to be interengaged between the top and bottom of the chamber 72, vertically thereof, so as to subdivide the chamber into relatively outer and inner peripheral portions, transverse the axis of the mold. The system is also adapted to meter the coolant into the outlet holes 58 of the mold from the inner peripheral portion of the chamber, and to infuse the coolant flow in the inner peripheral portion with a gas that operates to alter the heat transfer characteristics of the coolant on the surface of the molten metal body as the body exits from the bottom of the mold.

Referring now to FIGS. 6–14 in particular, it will be seen that the plate 66 has a circumferential groove 88 in the underside thereof, above the sump 75, and that an annular baffle 84 is circumposed about the axis of the mold in the groove, and welded to the underside of the plate at the groove, to depend from the plate in the sump when the plate is positioned over the case. The baffle in turn has an annular seal 90 secured about the bottom thereof, and when the plate is engaged with the case, so that the baffle is fully inserted in the sump, the seal engages the bottom of the chamber 72 and is sufficiently deformable and resiliently flexible to tightly interengage the baffle between the underside of the plate and the bottom of the chamber. When so interengaged, the baffle operates to subdivide the chamber into inner and outer peripheral portions, transverse the axis of the mold. But the baffle is equipped with a series of symmetrically angularly spaced holes 86 about the upper or lower annular end portion thereof, which not only admit the coolant to the inner peripheral portion from the outer, but admit it at a rate which is predetermined to meter the coolant to the holes 58 within a certain design specification.

The means for infusing gas in the flow through the inner peripheral portion of the chamber, are similar to those shown and described in U.S. Pat. No. 5,119,883. That is, those portions of the baffle 84 which oppose the sides and end walls of the cavity, have circumferentially extending ribs 92 on the outer peripheral surfaces thereof, at a level between the holes 86 in the baffle and the holes 58 in the case. The ribs in turn have symmetrically angularly spaced holes 94 therein, at the insides thereof. The holes in turn open into circumferentially extending grooves 56 about the inner peripheral wall of the baffle, the axial cross sections of which are radially elliptical or prolate so as to accommodate part annular O-ring sections therein (not shown) of porous, gas permeable material. As in the patent, pressurized gas is supplied to circumferentially extending channels 98 in the respective ribs. The channels communicate in turn with the holes 94, so as to force the gas through the bodies of the O-ring sections in such a way that the coolant flow between the holes 86 and 58 is infused with bubbles of gas that operate to modify the character of the coolant on the surface of the molten metal body. See the patent in this connection.

The pressurized gas is supplied to the respective channels 98 in a loop of pipe 100 which is suspended from the plate 66 by a set of hangers 104, and connected to the respective ribs by a set of tees 102 on the respective ends of the ribs adjacent the corners 57 of the mold. In the hangers, the pipe 100 is supplied with pressurized gas from a fluid transmission passage 106 in the plate, which is supplied in turn by an upstream fluid transmission passage 108 that emanates from a pipe fitting 110 on the outer peripheral edge of the plate. The pipe fitting is supplied in turn by an outside pressurized gas source (not shown) which is attached to the plate when needed.

Because the entire coolant character modification system 83 is suspended from the plate, and the baffle is able to seal between the plate and the bottom of the chamber when the plate is engaged on the case, the system can be preassembled, tested and adjusted outside of the case, before being inserted in the sump, and then readily removed for cleaning, servicing or replacement of parts thereafter, whenever desired, simply by lifting the plate.

Figure 6:
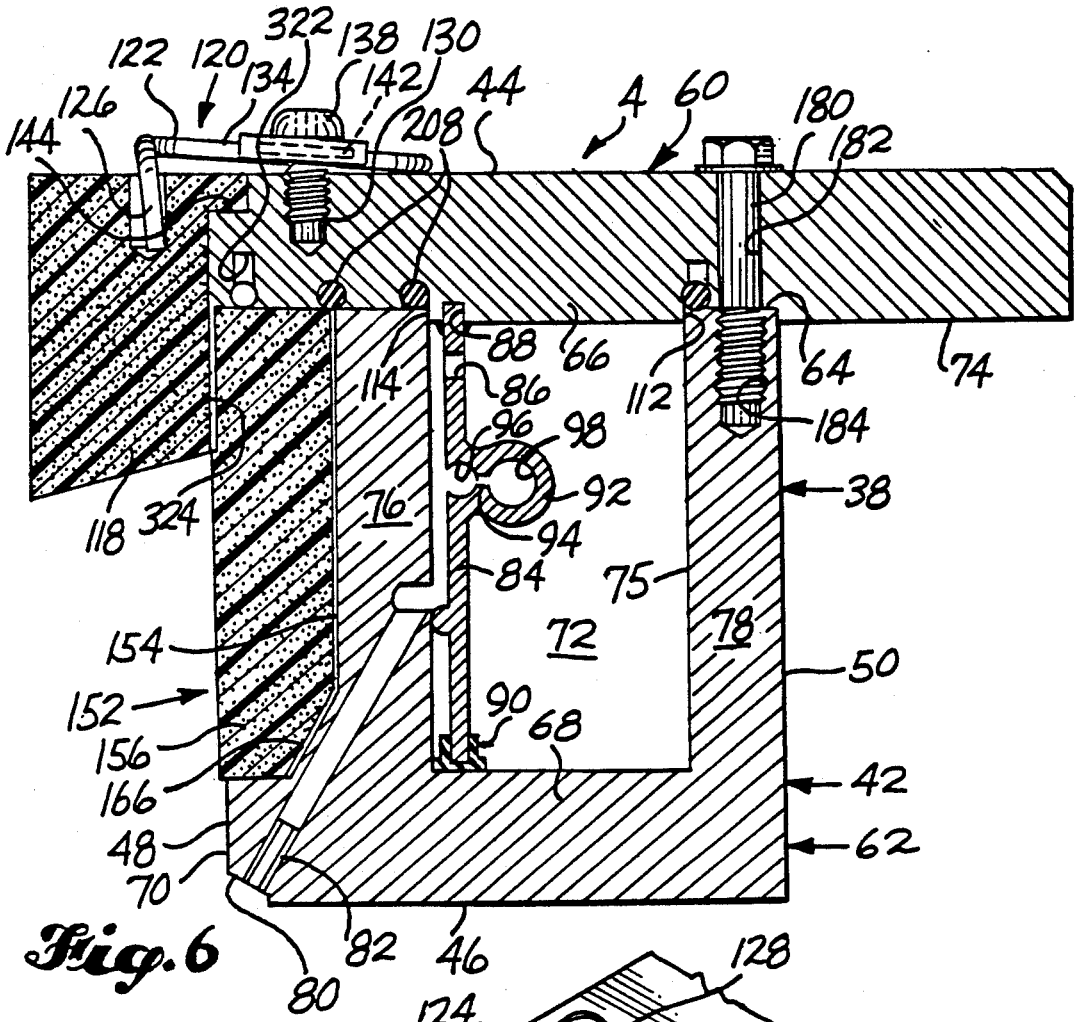
FIG. 6 is a vertical cross section through one end of the mold of the one metal casting unit when the molds of the units are equipped with a segmented graphite casting ring, a refractory top ring, and gas infusion means on the baffle in the chamber thereof.
Figure 7:
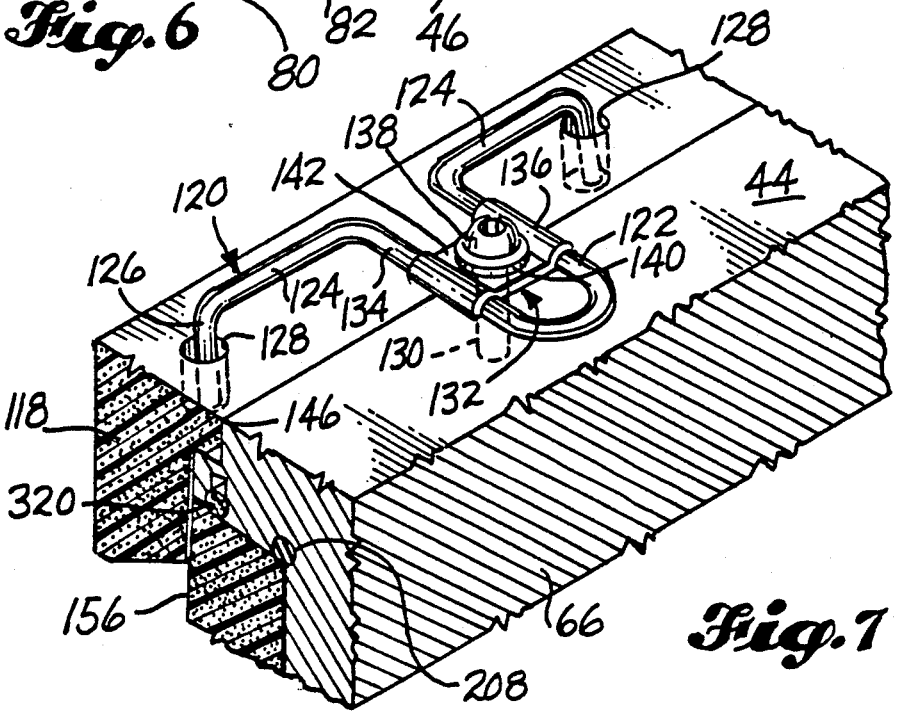
FIG. 7 is a part perspective view of the top of the mold in FIG. 6, at the inner peripheral edge thereof, to illustrate the means by which the top ring is clamped to the mold.
Figure 8:
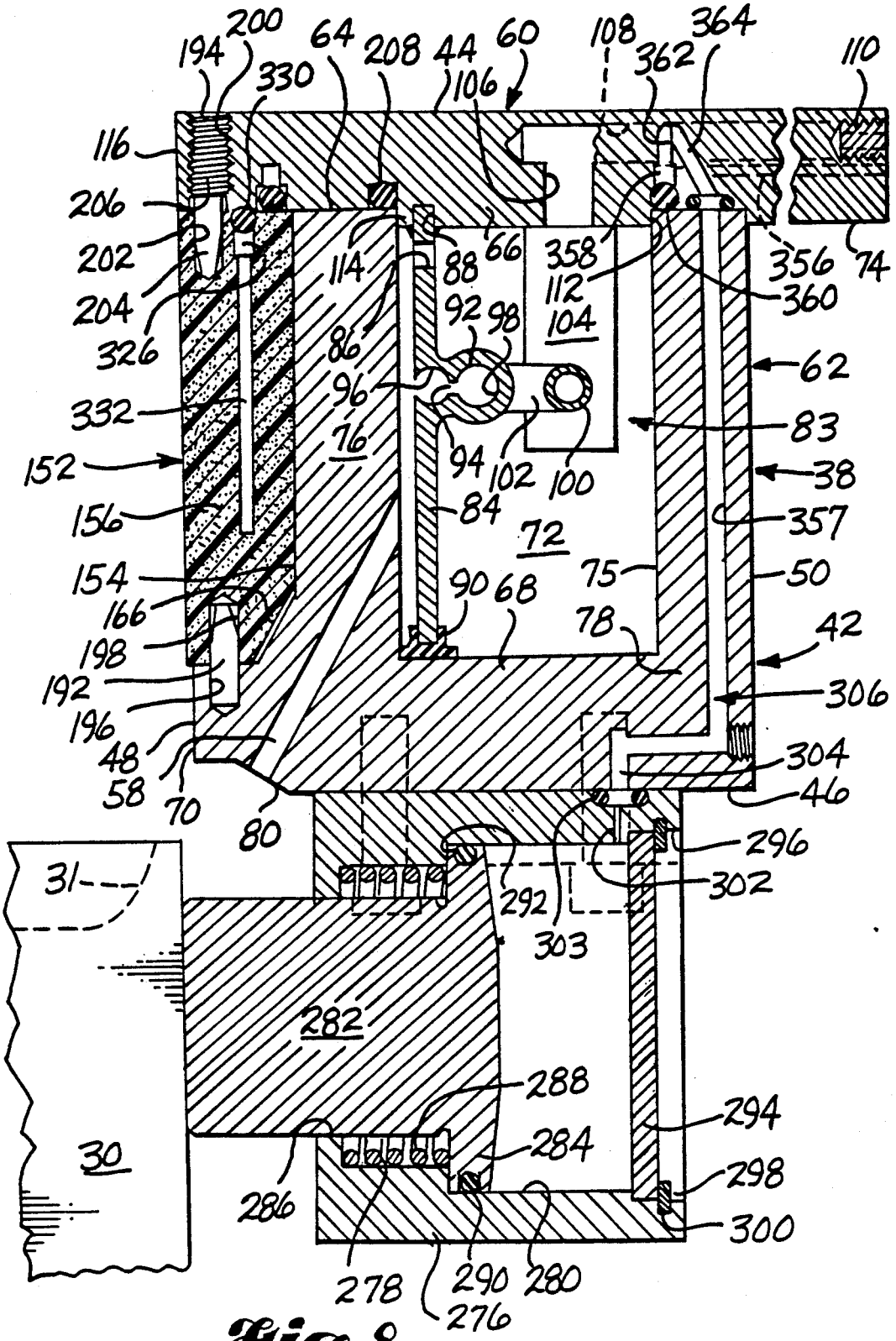
FIG. 8 is a vertical cross section through one end of the mold of the one metal casting unit, at the site of one air cylinder thereon for the alignment of the mold with the stool, and showing one technique for discharging oil through a graphite casting ring at the inner periphery of the joint, as well as a more detailed representation of the gas infusion means for the coolant.
Figure 10:
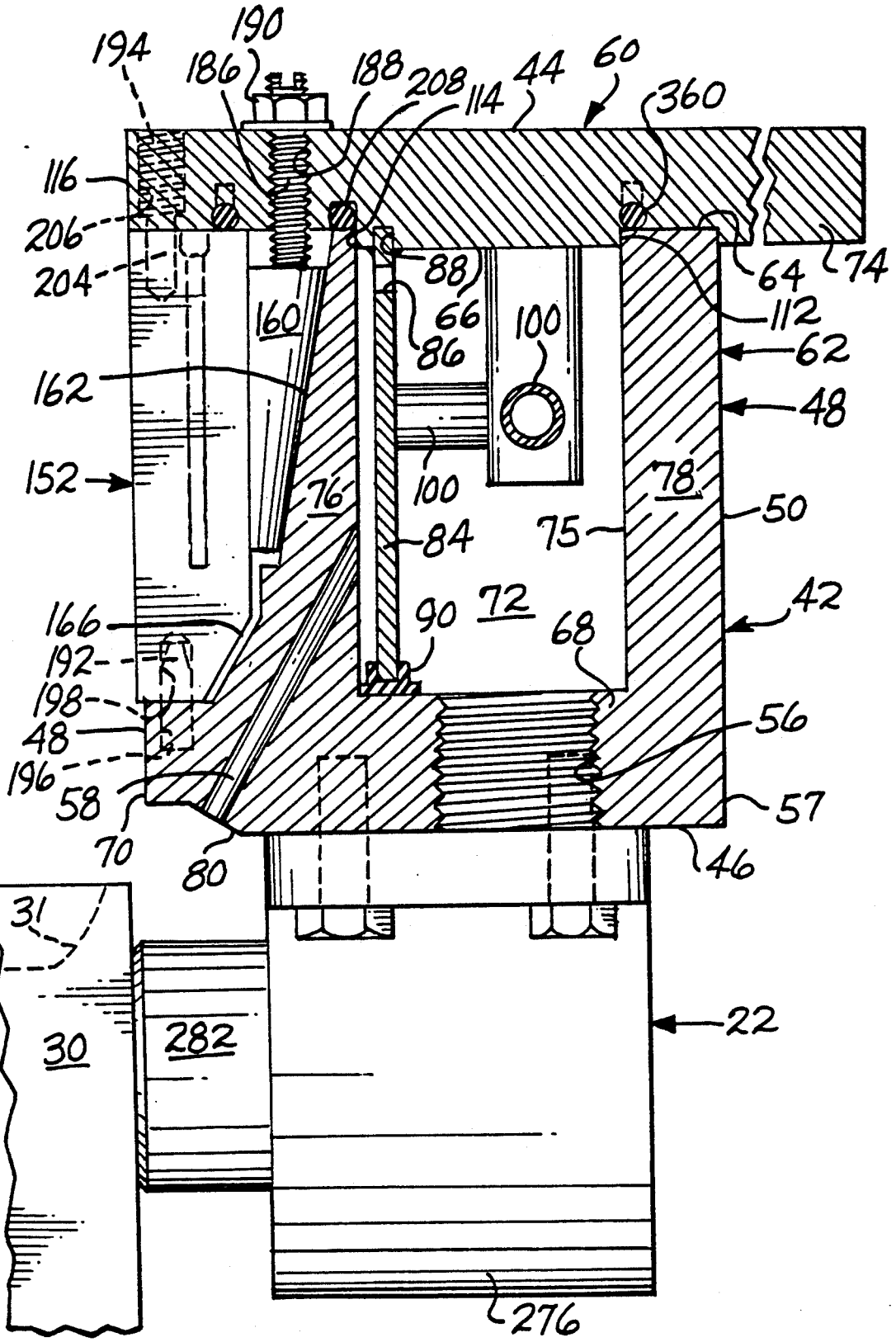
FIG. 10 is a vertical cross section of the mold seen in FIGS. 8 and 9, but at the corner of the mold, and illustrating the means for clamping the wall segments of the casting ring together.
Figure 13:
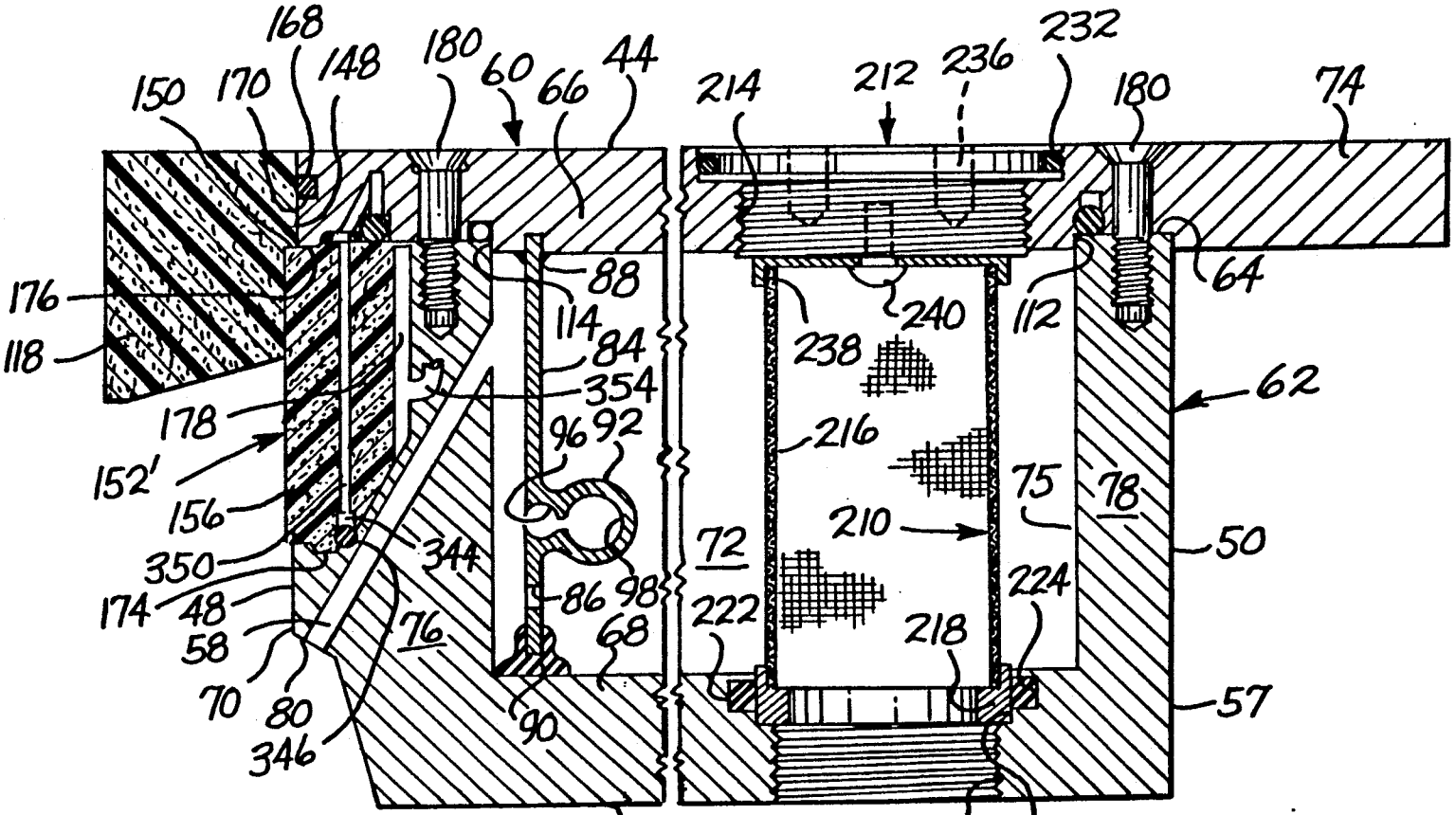
FIG. 13 is a vertical cross section through one end of the mold of the one metal casting unit when a bottom loading version of the oiling technique is employed, and illustrating in addition, at a plane circumferentially offset therefrom, a filtering device in the corner of the mold for the inlet thereof.

The plate itself has an annular groove 112 about the underside of the outer peripheral edge portion thereof, and an annular rabbet 114 about the underside of the inner peripheral edge portion thereof, so that when the plate is engaged with the upper end of the case, the land remaining between the groove and the rabbet engages in the sump to tightly close the top of the sump and form the chamber. The inside dimensions of the plate are either such that the plate forms the upper end opening 116 of the cavity in the mold body, as in FIGS. 4 and 5, where a conventional D.C. casting mold is shown; or the plate is equipped with a refractory top ring 118 at the upper end opening of the cavity, to form a hot top that overhangs the inner periphery 48 of the case, as in FIGS. 6, 7 and 13. In the latter case, however, the plate is commonly also equipped with a series of clips 120 that are symmetrically angularly arrayed about the upper side 44 of the plate to be used in securing the top ring to the plate, as seen in FIGS. 6 and 7. The clips have U-shaped wire-like bodies 122, with laterally outstanding L-shaped arms 124 thereon, the tips 126 of which are bent inwardly of the bodies of the clips, to engage in pairs of holes 128 in the top of the ring when the respective clips are secured to the upper side of the plate as shown in FIGS. 6 and 7. For this purpose, each clip is accompanied by a threaded hole 130 in the upper side of the plate, and by a saddle-like cleat 132 which is adapted to bridge between the legs 134 of the clip, and has U-shaped wings 136 on the lateral edges thereof, to engage over the respective legs. A capscrew 138 is equipped with a washer 140 and inserted through an aperture (not shown) in the saddle 142 of the cleat, to threadedly engage with the hole 130 in the plate and clamp the clip to the plate while the tips 126 of the arms seize the top ring and secure it to the inner peripheral edge of the plate. In the embodiment of FIGS. 6 and 7, the edge has a rabbet 144 about the upper end thereof, and the top ring has a flange 146 on the upper end thereof which engages in the rabbet of the plate to leave the top ring clamped to the mold. In FIG. 13, the clips are omitted from the cross section, but again the top ring is equipped with a flange 148 that overlies a rabbet in the inner peripheral edge of the mold at its top so that the ring is effectively clamped to the mold. The shoulder 150 of the rabbet is provided by a graphite casting ring 152 that is tightly clamped between the plate and the case for purposes of practicing the process of U.S. Pat. Nos. 4,598,763 and 4,947,925, as shall be explained.

Referring now to FIGS. 6–13 in particular, it will be seen that the inner peripheral wall 76 of the case has an annular rabbet 154 thereabout at the inner periphery of the case, and in accordance with U.S. Pat. No. 4,947,925, a graphite casting ring 152 comprising four elongated but individually discrete wall segments 156 of graphite, is seated in the rabbet and clamped within the ambit of the mold, transverse the axis, as well as between the plate and the case, axially of the mold. The wall segments are arranged about the rabbet like the sides of a picture frame, and then abutted together, sash-like, at their mitered ends 158 (FIGS. 11 and 12), to form the ring; whereafter the plate 66 is applied to the upper end of the case to clamp the ring between it and the bottom of the rabbet. Meanwhile, the clamping action transversely of the axis, is provided by a set of wedges 160 which are engaged in the corners of the case to tightly engage the mitered ends of the segments with one another and form a closed ring. The corners 57 have tapered sockets 162 therein for this purpose, and the taper of the sockets is such that the downward insertion of the wedges produces a sufficient horizontal component of force against the adjacent joint of the picture frame to tightly engage the ends of the adjacent segments with one another. A strip 164 of insulative refractory material is commonly inserted between the ends of the segments beforehand, however, to seal the joint at the time it is made. The bottom of the rabbet 154 may also have a filleted corner 166 in the step thereof, to aid in this action, as seen in several of the Figures.

As indicated earlier, the graphite casting ring 152 in FIG. 13 has smaller inner peripheral dimensions than the inner peripheral edge of the plate, so as to provide a shoulder 150 at the top end thereof on which the flange 148 of the refractory top ring 118 can be clamped to the mold. Commonly, an elastomeric O-ring 168 of sealant material is added between the plate and the top ring in a circumferential groove 170 circumscribed about the inner peripheral edge of the plate.

In FIG. 13, moreover, the graphite casting ring 152 has an annular rib 174 formed about the bottom end thereof, to engage in a corresponding groove in the shoulder of the rabbet, and the inner peripheral edge of the casting ring is rabbetted at the top thereof, to engage behind an annular lip 176 on the bottom of the plate at the inner peripheral edge thereof. Together with the wedges 160 and the filleted corner 166 of the case, these features leave the casting ring 152 tightly invested within the case at the inner periphery thereof, notwithstanding that there is an annular clearance 178 formed between the outer periphery of the ring and the opposing vertical surface of the rabbet 154, the purpose for which will be explained more fully hereinafter.

The plate 66 is secured to the upper end of the case by a set of capscrews 180 which are passed through corresponding holes 182 in the plate, and threaded into opposing holes 184 in the walls of the case. The wedges 160 are driven into position by a set of screw shanks 186 that are threaded into holes 188 thereabove in the plate. The threading of the shanks reacts with that of the holes to drive the wedges into position, and nuts 190 on the tops of the shanks lock the wedges in position. In FIGS. 6–12, the respective segments 156 of the casting ring are secured at their ends by sets of dowels 192, 194, the lower of which, 192, are upstanding in holes 196 in the shoulder of the case, and engaged in opposing holes 198 in the bottoms of the segments. The upper dowels 194 are threaded into sockets 200 in the inner peripheral edge portion of the plate, which in turn open into opposing holes 202 in the upper ends of the segments. Pins 204 depend from the threaded shanks 206 of the dowels 194 to engage in the holes 202 of the segments and effectively secure the segments to the mold.

Elastomeric sealant rings 208 are commonly arranged about the joint 64 between the inner peripheral wall 76 of the case and the underside of the plate, to provide a seal between the chamber and the cavity of the mold. The joint is preferably further secured against leakage, however, in the manner of U.S. Pat. No. 4,597,432, as shall be explained hereinafter.

The inlet 56 at each corner 57 of the mold may be accompanied by a filtering device 210 that is suspended from a plug 212 which is removably engaged in a port 214 directly above the inlet in the plate 66. The filtering device 210 comprises a cylindrical screen 216 which has an annular shoe 218 secured about the bottom end thereof, for engagement in an annular rabbet 220 formed about the upper end of the inlet. Unlike the inlet, which is threaded, the rabbet 220 is smooth-walled and sized to receive the shoe when the filtering device is suspended in the chamber as the plug is engaged in the port. An elastomeric O-ring 222 seated in a circumferential groove 224 about the wall of the rabbet, operates to provide a seal between the shoe and the bottom of the case. The port is also threaded, and also has an annular rabbet 226 about the top edge thereof. The plug has a threaded base 228, and a flange 230 about the top thereof, which is adapted to be received in the rabbet of the port, flush with the top of the plate, and is equipped with an elastomeric O-ring 232 in a circumferential groove 234 thereabout, to seal the closure made by the plug in the plate. The plug is also equipped with a pair of diametrically opposing sockets 236 in the top thereof, to receive a spanner wrench (not shown) with which to rotate the plug into the port when the filtering device is to be suspended in the chamber. The screen of the device, meanwhile, has a cap 238 secured about the top thereof, which is rotatably engaged on the shank of a round headed pin 240 that is screwed into the base of the plug, but not tightly engaged against it, so that the screen and plug can rotate in relation to one another about the vertical axis thereof. In this way, the shoe 218 of the screen can be engaged in the rabbet 220 of the inlet as soon as the shoe "bottoms out" in the chamber, and will remain engaged in the rabbet even while the plug is given the final turns in the port with which to tightly close the port at the flange 230 on the plug.

The filtering device 210 operates to filter debris from the coolant as it passes through the chamber between the inlets 56 and the outlet holes 58 of the case. In time, however, debris will accumulate on the screen 216 of the device to the point at which the back pressure in the screen will interfere with the designed flow for the coolant. The screen needs to be removed from time to time, therefore, to remove the debris from it, or to replace it with a new screen.

Figure 15:
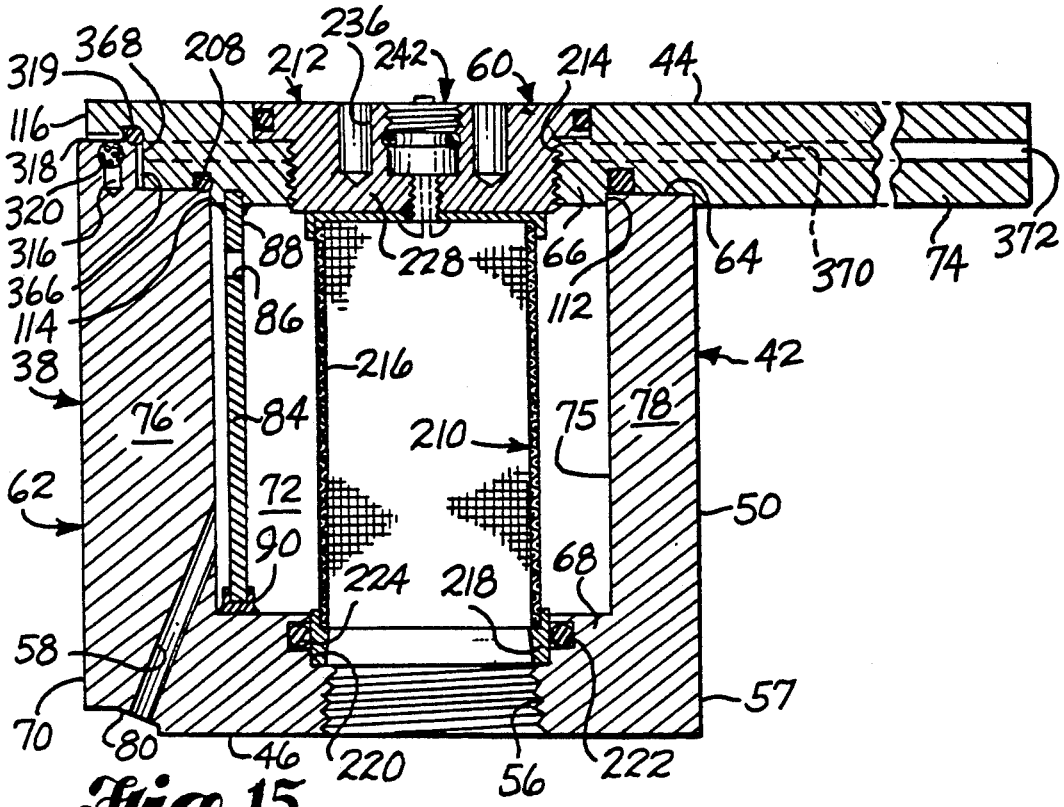
FIG. 15 is a vertical cross section through one end of the mold of the one metal casting unit when the mold is equipped to discharge leakage coolant entering the joint from the chamber, and illustrating in addition, a filtering device equipped with a further device for indicating the presence of undesirable back pressure in the filter.
Figure 16:
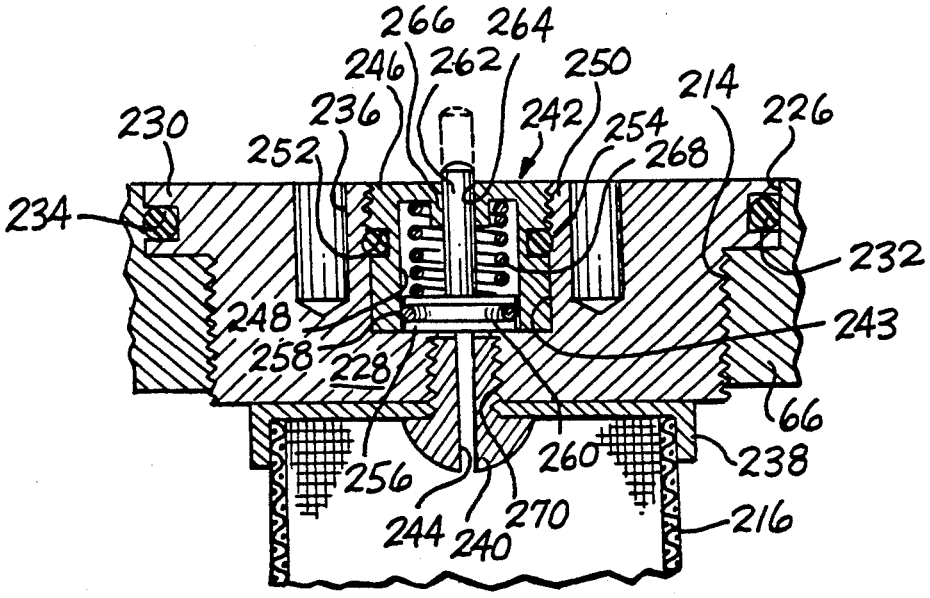
FIG. 16 is a greatly enlarged cross sectional view of the indicator device seen in FIG. 15.

In FIGS. 15 and 16, the plug is equipped with a device 242 for indicating when the back pressure in the screen has reached such a level. Referring now then to these Figures in particular, it will be seen that the upper end portion of the plug has a socket 243 therein, at the center thereof, and the pin has a hole 244 therethrough, axially of the screen, which opens into the socket. The indicator device comprises a cylindrical housing 246 which has a cylindrical bore 248 in the lower end portion thereof, and external threading 250 about the upper end portion thereof. The housing is also equipped with a circumferential groove 252, and an elastomeric O-ring 254 therein, at a level below the threading, so that when the device is threaded into the socket, the seal secures it against leakage from the chamber 72. In the bore of the housing, moreover, the device has a piston 256, with an elastomeric O-ring 258 seated in a circumferential groove 260 thereabout, and a plunger-like rod 262 upstanding on the piston in a hole 264 in the top of the housing at the center thereof. The hole has an annular rim 266 about the lower or inside end thereof, and a spring 268 is caged about the plunger and the rim of the hole, between the piston and the upper end of the bore, to urge the piston against the bottom of the socket at a shoulder formed about the hole 270 for the pin 244. When the back pressure in the screen reaches a level at which the piston is raised against the bias of the spring, the rod 262 appears at the top of the plate 66 and evinces the fact that the screen requires cleaning or replacement.

The casting units 4 are somewhat loosely received in the apertures 6 of the table 2, to enable the units to align with the stool caps 30. Referring again to FIGS. 1–3, as well as FIGS. 8 and 9, it will be seen that the various molds 38 of the casting units 4 are restrained against lateral movement on top of the plate 18 of the table by pairs of bolts 272 which pass through oversized holes 274 in the flanges 74 of the molds. Accordingly, when the bolts are loosely secured to the plate, and the air cylinders 22 are operated to align the molds with the stool caps 30, the molds can shift within the apertures 6, relative to the caps, to assume alignment with the caps. Then, given alignment between the molds and the caps, the bolts can be tightened down to lock the molds in that condition for the casting operation.

The cylinders 22 have flanged housings 276 and are bolted to the lower ends 46 of the molds by their flanges. Inside, the housings have deeply recessed sockets 278 in the outside ends thereof, which are cylindrical and open into the inside ends of the housings at the centers thereof. Each socket 278 is also counterbored at its outside end, and then rabbetted at the outside end of the counterbore 280. A cylindrical piston 282 with an annular flange 284 about the relatively outside end thereof, is slideably engaged in the opening 286 of the socket, and a helical spring 288 is caged between the flange of the piston and the bottom of the socket to bias the piston in the direction of the outside end of the housing. The flange, meanwhile, slidably engages within the wall of the counterbore 280, and has an elastomeric O-ring 290 seated in a circumferential groove 292 thereabout, to seal the joint between it and the wall of the counterbore. In addition, at the opposite end of the counterbore, on the outside of the housing, a closure disc 294 is seated in the annular rabbet 296 of the counterbore, and tightly secured to the shoulder of the rabbet by a retainer ring 298 which snap engages about a circumferential groove 300 in the annular wall of the rabbet. Compressed air is supplied to the outside face of the piston, in the counterbore of the socket, through an inlet 302 which is disposed in the cylindrical wall of the housing, at the juncture between the housing and the lower end of the mold. The inlet is counterbored, equipped with an O-ring seal 303, and opposed by the discharge end 304 of a fluid transmission system 306 in the mold, the details of which will be explained more fully hereinafter.

When the table 2 is in the horizontal position thereof, and the platen 10 is elevated to a level at which the stool caps 30 are disposed immediately below the lower ends 46 of the cases, and within the ambit of the respective sets of cylinders 22 thereon, pressurized air is supplied to the sets of cylinders to advance the pistons 282 thereof against the bias of the respective springs 288 and into engagement with the sides of the caps. Then, when the bodies of the molds have finished shifting into alignment with the caps on the axes 40 of the mold, the bolts 272 in the top plate of the table are tightened to lock the molds in alignment with the caps at the holes 274 in the flanges 74 of the molds.

Referring again to FIGS. 4–15, and firstly to FIG. 9, it will be seen that the outer peripheral edge of the flange of the mold in that Figure has a threaded female fitting 308 therein to serve as a source of pressurized fluid on the plate 66 when a male fitting (not shown) is attached to the female fitting from a pressurized fluid supply. Proceeding next to FIGS. 4 and 5 on the same sheet, it will be seen that the plate in those Figures has a fluid flow passage 310 therein which emanates from such a fitting, and communicates with a pair of passages 312 and 314 in the top of the inner peripheral wall 76 of the case, through a cross connection therebetween at the joint 64 , having an O-ring 315 circumposed thereabout. The cross connection is formed between the horizontal surface of the rabbet 114 in the plate, and the outer peripheral top surface of the wall 76 thereopposite. Circumposed about the axis of the mold, radially inside of the two surfaces, is an annular bench 317 formed by rabbeting the top of the wall 76 at its outer periphery, and rabbeting the bottom edge of the plate at its inner periphery, to form an axially extending step therebetween as shown. At the top of the bench, an annular groove 316 is circumposed about the axis of the mold for much of the depth of the bench, and the top of the groove is counter grooved to have a semicircular cross section in the upper end portion thereof which is wider than the bottom portion thereof. The passage 314 in the wall 76 opens into the bottom portion of the groove to charge the groove with fluid, but in the semicircular top portion of the groove, an annular rope 320 of porous, fluid permeable material is seated in the groove, to control the discharge of fluid from the groove. The rope is normally oil permeable and sized to circumscribe the entire perimeter of the cavity, while the bottom portion of the groove may be circumferentially segmented so as to circumscribe only the opposing sides and ends of the mold, but not the corners thereof. In addition, radially outside of the groove 316, and closer to the step, is still another groove in the rabbet of the plate, which has an O-ring 319 of sealant material seated therein, once again to circumscribe the full perimeter of the cavity at the joint. When pressurized oil is supplied to the fitting 308, the oil is charged into the bottom portion of the groove 316 and applied under pressure to the rope 320. The rope, meanwhile, is captured between the faces of the plate and the wall 76 of the case, at the inner periphery of the joint 64, as is the O-ring 319, but radially inside of the rope and the O-ring, the faces of the plate and the wall, or one of them alone, is scored so as to provide an annular slit 318 about the inner periphery of the joint through which the oil can slowly discharge into the cavity at the inner periphery of the case, to lubricate the casting surface 48 on the inner periphery of the case.

In FIGS. 6 and 7, where the mold is equipped with a casting ring 152 of graphite or the like at the inner periphery of the joint, and the cavity has a refractory top ring 118 seated in the top opening thereof, an annular groove 322 similar to the groove 316, is formed about the cavity on the underside of the plate 66, and is equipped with a rope 320 therein, opposite the upper end of the casting ring. Moreover, in addition to a slit 318 between the casting ring and the underside of the inner peripheral edge of the plate, an annular clearance 324 is provided between the outer peripheral surface of the top ring and the inner peripheral surface of the casting ring, at the top thereof, so that oil transmitted to the groove 322 from a fitting 308 on the flange of the plate, can discharge from the rope into the slit, and then downward into the cavity through the clearance 324 between the rings.

The mold in FIG. 15 is also equipped with a similar system for oiling the casting surface of the mold at the inner periphery of the joint. Once again, the inner peripheral wall 76 of the case has at least a part annular groove 316 circumposed about the cavity of the mold, in a bench at the top of the wall, and a rope 320 of porous, oil permeable material is captured between the top portion of the groove and the opposing inner peripheral edge of the plate, to discharge oil onto the casting surface through an annular slit 318 circumposed about the cavity at the inner periphery of the joint 64.

In FIGS. 8–14, the casting ring 152 is segmented, and circumferentially extending fluid flow passages such as those defined by the ropes 320 in the grooves 316 and 322 of FIGS. 4–7 and 15, are now incorporated in the bodies of the segments 156 instead, between the annular ends thereof, and the oil is forced to discharge through the bodies of the segments rather than through the ropes, by employing rings of fluid impermeable material at the mouths of the grooves which define the passages, rather than rings of fluid permeable material such as the ropes provide. In addition, the joint 64 now has a pair of circumferentially extending fluid flow passages at each segment, and the respective passages in each pair are spaced apart from one another transverse the axis of the mold. The oil is circulated about the axis of the mold in the more radially outlying passages of the respective pairs, and then discharged at circumferentially spaced sites therein, to the more radially inlying passages, which in turn are interposed between the annular ends of the respective segments 156 of the graphite casting ring 152.

Referring first to the embodiment shown in FIGS. 8–12, it will be seen that the upper annular ends of the segments 156 of the casting ring 152 have part annular grooves 326 therein, which extend circumferentially of the ring and have semi-circular part annular countergrooves 328 of wider width in the tops thereof, which extend from segment to segment so as to extend about the entire perimeter of the ring. An O-ring 330 of sealant material is seated in the semi-circular upper portions 328 of the grooves, so as to encircle the cavity at the top of the casting ring, including across the joints 158 between the respective segments thereof. Meanwhile, the bottom portions 326 of the grooves are left open, and have series of holes 332 depending therefrom in the bodies of the segments, which reach well below the mid-level of the respective segments.

Radially outlying the grooves 326, in the underside of the inner peripheral edge portion of the plate 66, is an annular groove 334 which encircles the axis of the mold and is similar to the groove 322 in FIG. 6, but equipped with an elastomeric O-ring 336 of sealant material, rather than the rope 320. Once again, the plate has a passage 333 therein, which emanates from a pressurized fluid inlet 308 and communicates with the groove 334. At sites corresponding to the end portions of the segments 156 of the casting ring, the groove 334 communicates with the bottom portions of the grooves 326 in the tops of the segments, through pairs of oblique passages 338 and 340 that extend within the edge portion of the plate and the upper end portions of the segments of the casting ring, respectively. The passages interconnect with one another at each site through cross connections therebetween at the joint 64, having O-rings 342 circumposed thereabout. When oil is injected into the passage 333 of the plate, to circulate about the joint at the groove 334, and feed the bottom portions of the grooves 326 in the segments of the casting rings, at the connections formed by the passages 338, 340 and the O-rings 342 therebetween, the oil encounters the sealant ring 330 captured in the joint at the top of the casting ring, and is forced to discharge through the bodies of the segments in the direction of the inner periphery of the ring. If desired, different oiling effects can be achieved from point to point about the axis of the mold, by varying the sizing and/or frequency of the holes 332.

Figure 14:
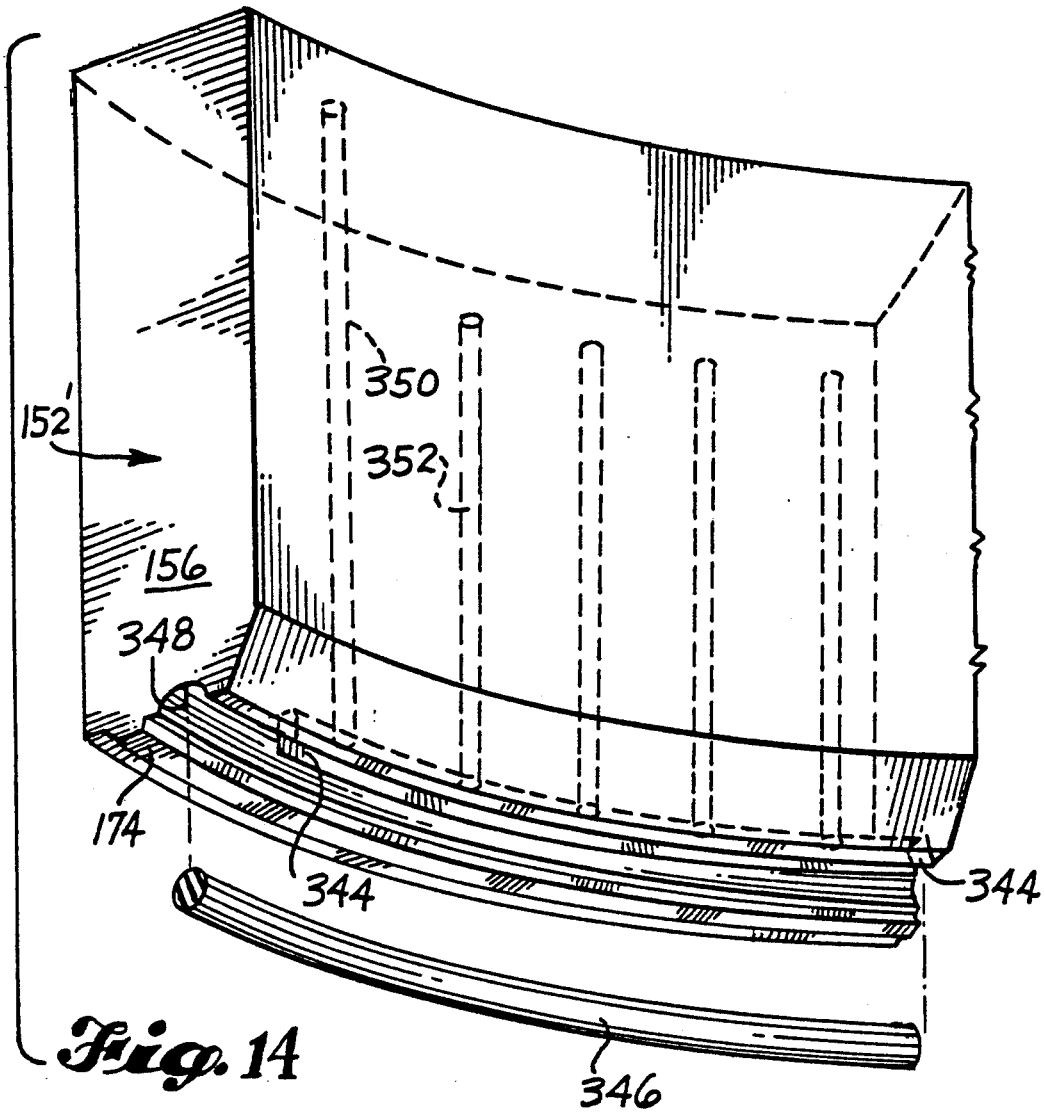
FIG. 14 is a part perspective view of the bottom of one segment of the graphite casting ring in FIG. 13.

The top loaded discharge arrangement of FIGS. 8–12 is satisfactory, but it has the drawback that when the pressure on the oil is released, considerable pressure nevertheless remains in the body of the casting ring to discharge oil at the inner periphery of the ring even after the casting operation has been completed. In FIGS. 13 and 14, therefore, part annular grooves 344 are formed in the bottom ends of the segments of the casting ring, just outside the rib 174 thereon, and an O-ring 346 of sealant material is seated about the joint in the semicircular bottom portions 348 of the grooves, not only to form fluid flow passages in the grooves 344 for the oil discharge function of the casting ring, but also to seal the joint itself between the respective casing means, that is, between the bottom of the casting ring and the shoulder of the rabbet 154 in the case. The grooves 344 are fed in this instance by pairs of holes 350 in the end portions of the segments, which depend the full depth of the respective segments and interconnect the grooves with a circulatory system similar to that seen at 308, 333, 334, 336, 338 and 342 in FIG. 9. Meanwhile, the oil charged into the grooves 344 from the system, is forced into a series of risers 352 which upstand in the bodies of the segments from the grooves. The risers will discharge the oil at the inner periphery of the casting ring during the casting operation, but at the conclusion thereof, when the pressure is released from the oil, will readily drain and relieve the casting ring of any pressure tending to discharge oil at the inner periphery thereof.

Figure 9:
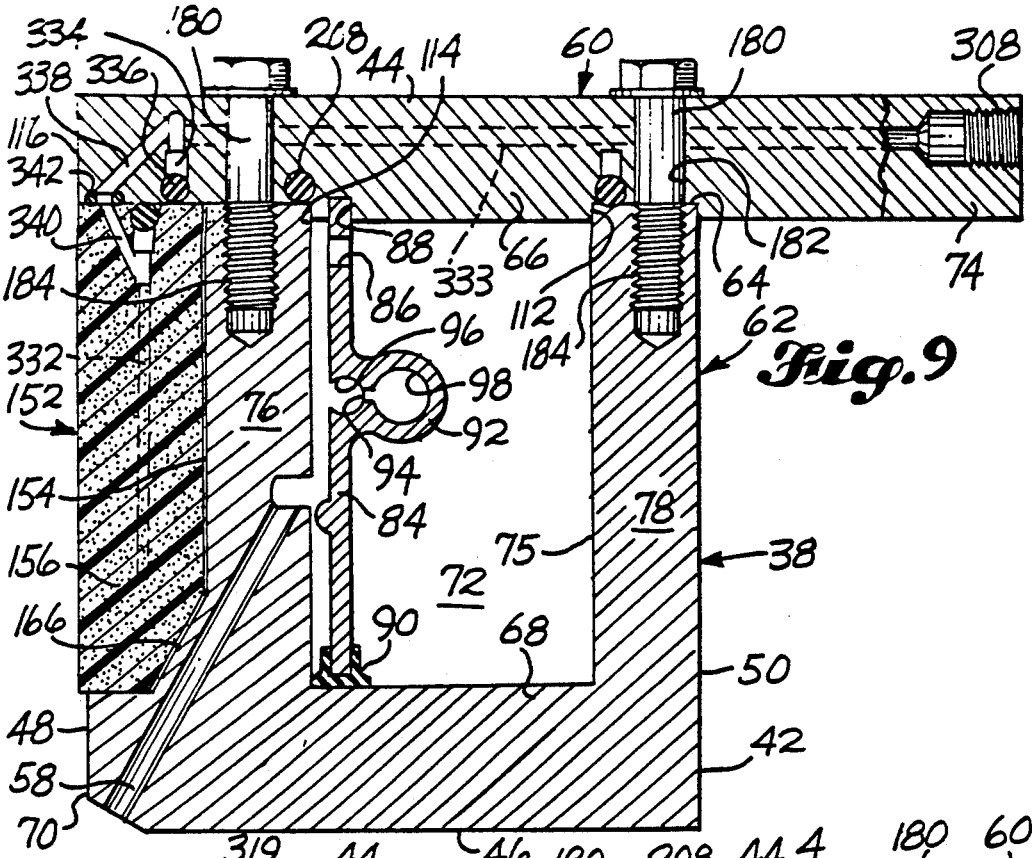
FIG. 9 is a vertical cross section through one end of the mold seen in FIG. 8, but in a plane spaced apart circumferentially from the cross sectional plane of FIG. 8 to further illustrate the oil discharge technique.
Figure 5:
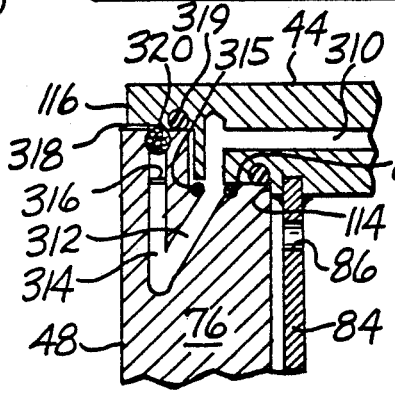
FIG. 5 is a part vertical cross section at the top of the end of the mold seen in FIG. 4, but in a plane spaced apart circumferentially from the cross sectional plane of FIG. 4.
Figure 4:
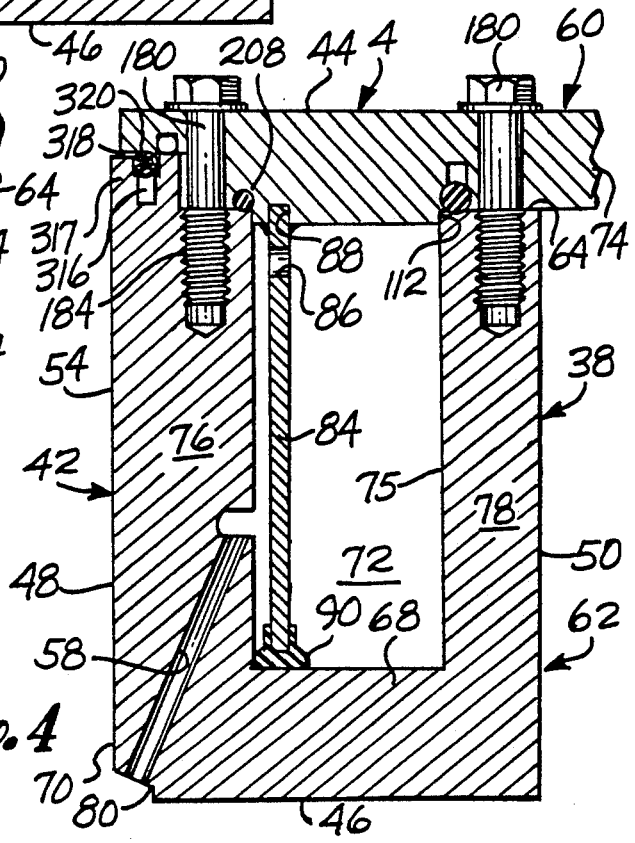
FIG. 4 is a vertical cross section through one end of the aforesaid mold of the one metal casting unit when the molds of the units are adapted as conventional D.C. casting molds.

A circulatory system such as that seen at 308, 333, 334, 336, 338, and 342 in FIG. 9 may also be employed to feed pressurized air to the annular clearance 178 (FIG. 13) formed about the outer periphery of the casting ring. That is, rather than supplying oil to it, the system may be charged with air, and at selected sites about the perimeter of the system, the air may be discharged into the clearance at inlets 354 therein. The air discharges in turn at the inner periphery of the casting ring, and together with the oil, produces an oil encompassed annulus of air about the inner periphery of the ring, to assist the molten metal body in escaping the cavity without galling. See U.S. Pat. Nos. 4,598,763 and 4,947,925 for more details about the procedure.

A similar system is in fact formed in the joint between the underside of the plate and the outer peripheral wall 78 of the case, to supply pressurized air to the cylinders 22 at the bottom of the mold. Referring again to FIG. 8, it will be seen that the plate has a supply passage 356 therein, and an annular groove 358 in the underside thereof, which in turn has an O-ring 360 of sealant material between it and the top of the wall. Pressurized air is supplied to the top portion of the groove through the passage 356, and at the site of each cylinder, passages 362 and 364 in the plate provide a connection between the groove and the fluid transmission system 306 of the case which supplies the inlet 302 of the corresponding cylinder. The fluid transmission system in turn comprises simply a passage 357 in the wall of the case, and an elbowed connection between the passage and the inlet at the discharge end 304 of the system.

As indicated earlier, the chamber 72 itself may be a source of fluid which requires discharge to the outside of the mold, and therefore, the technique of U.S. Pat. No. 4,597,432 is employed at the raised step 366 of the joint between the inner peripheral edge portion of the plate 66 and the inner peripheral wall 76 of the case in FIGS. 15 and 16. The joint has an O-ring 208 at the outer periphery of the rabbet in the plate, and another O-ring 319 at the top of the step. The joint also has an annular clearance 368 between the opposing surfaces of the step, and the clearance is discharged to an outlet 372 at the inner peripheral edge of the flange, by a passage 370 in the plate. Should liquid coolant in the chamber leak past the O-ring 208 in the joint, the coolant will be intercepted in the clearance by the passage 370, and discharged to the outside of the mold, before the coolant can reach the O-ring 319 at the top of the step and threaten the integrity of the unit at the inner periphery of the joint.

We claim:

1. An annular metal casting unit of the type which is operatively supported in an aperture in a metal casting table of a molten metal casting apparatus, so as to form an open ended bore therein through which the molten metal to be cast in the casting operation, is poured along a vertical axis of the table and cast into a molten metal body that progressively elongates along the axis as it emerges from the bottom of the bore, and wherein during the casting operation, a liquid coolant is discharged onto the molten metal body as it emerges from the bottom of the bore, to direct cool the metal therein, comprising:

an annular mold having a vertical axis and an annular body circumposed thereabout, which has upper and lower annular ends thereon, relatively inner and outer annular peripheries thereabout, and a bore therethrough, the cavity of which is formed about the axis of the mold and opens into the ends of the mold body so that the bore of the mold body can form the bore of the table when the unit is supported in the aperture of the table coaxially thereof, the mold body comprising a pair of relatively upper and lower casing means which are annular, circumposed about the axis of the mold, and superposed on one another so as to have mutually opposing faces thereon which are engaged with one another about the axis to form an annular joint therebetween which extends from the inner periphery of the mold body to the outer periphery thereof, the casing means comprising a pair of relatively upper and lower casing members which are annular bodies that are circumposed about the axis and have mutually opposing faces thereon which are engaged with one another at the joint, the body of the relatively lower casing member being monolithic from the inner periphery to the outer periphery thereof, and from the lower end thereof to the face thereof disposed at the joint, the body of the relatively lower casing member defining the outer periphery of the mold body at the joint, the lower end opening of the cavity at the inner periphery of the mold body, and an annular sump in the face of the relatively lower casing member which is disposed at the joint, the face of the relatively upper casing member which is disposed at the joint, covering the top of the sump so that an annular chamber is formed in the relatively lower casing member for the retention of liquid coolant in the mold body during the casting operation, and the relatively upper casing member projecting relatively radially outwardly of the axis of the mold from the joint to form a flange on the body of the mold which overhangs the relatively lower casing member on opposite sides of the mold, and is operable to engage the top of the table to provide support for the metal casting unit when the unit is inserted in the aperture of the table from above the table, and the mold body having an inlet therein through which liquid coolant can be charged into the chamber, and the chamber having an outlet for the liquid coolant extending into the lower end portion of the body of the relatively lower casing member and opening adjacent the lower end opening of the cavity to discharge the coolant onto the molten metal body as it emerges from the bottom of the bore in the mold body.

2. The annular metal casting unit according to claim 1 wherein the relatively lower casing member is relatively thick axially of the mold, so as to form the greater portion of the axial length of the mold body at the outer periphery thereof, and the relatively upper casing member is relatively thin axially of the mold, so as to constitute a plate-like collar for the relatively lower casing member, which is adapted to form a flange on the opposing sides of the mold.

3. The annular metal casting unit according to claim 1 wherein the outline of the cavity at the inner periphery of the relatively upper casing means corresponds to the outline of the cavity at the inner periphery of the relatively lower casing means, transverse the axis of the mold, so that the mold body has a relatively straight bore therethrough axially of the mold.

4. The annular metal casting unit according to claim 1 wherein the inner periphery of the relatively upper casing means is smaller in outline than the inner periphery of the relatively lower casing means, transverse the axis of the mold, so that the relatively inner peripheral portion of the relatively upper casing means overhangs the relatively lower casing means at the inner periphery of the joint.

5. The annular metal casting unit according to claim 4 wherein the relatively upper casing means are formed as a relatively axially thin plate-like collar which is refractory lined at the inner periphery thereof and has the necessary outer and inner peripheral dimensions to form the flange and the overhang at the upper end of the mold body.

6. The annular metal casting unit according to claim 4 wherein the relatively inner peripheral portion of the relatively upper casing means comprises a refractory top ring which is circumposed about the axis of the mold in the upper end opening of the mold body to overhang the cavity at the inner periphery of the joint and form a hot top for the mold.

7. The annular metal casting unit according to claim 6 wherein the relatively upper casing means have an annular shoulder circumposed about the axis of the mold at the inner periphery thereof, the refractory top ring is supported on the shoulder to overhang the cavity at the inner periphery of the joint, and the relatively upper casing means have means thereon with which to clamp the refractory top ring to the shoulder at the upper end of the mold body.

8. The annular metal casting unit according to claim 1 wherein the body of the mold has a ring of graphite or the like circumposed about the inner periphery thereof, to form a liner for the cavity at the bore thereof.

9. The annular metal casting unit according to claim 8 wherein the ring of graphite or the like is circumposed about the axis of the mold at the inner periphery of the joint, and is clamped at its ends between the casing members to form a liner for the cavity at the upper end portion thereof.

10. The annular metal casting unit according to claim 8 wherein the ring comprises a plurality of individually discrete wall segments of graphite or the like, which are arranged in a plane perpendicular to the axis of the mold and clamped together transversely of the axis to form the ring.

11. The annular metal casting unit according to claim 1 wherein the inlet for the liquid coolant is formed in the lower end of the mold body.

12. The annular metal casting unit according to claim 1 wherein the outlet for the coolant discharge takes the form of a series of holes which are symmetrically arrayed about the axis of the mold in the relatively lower casing member, to discharge the coolant about the lower end opening of the cavity.

13. The annular metal casting unit according to claim 1 further comprising a device for monitoring the liquid coolant flow between the inlet and the outlet.

14. The annular metal casting unit according to claim 13 wherein the monitoring device is mounted on the relatively upper casing member so as to be inserted in the chamber between the inlet and the outlet.

15. The annular metal casting unit according to claim 13 wherein the monitoring device is suspended in the chamber on the relatively upper casing member.

16. The annular metal casting unit according to claim 1 wherein the mold body has means therein which are operatively interposed between the inlet and the outlet to monitor the coolant flow during the casting operation, and the relatively upper casing member has a port therein for access to the monitoring means.

17. The annular metal casting unit according to claim 16 wherein the monitoring means include a device for filtering the flow of coolant through the chamber, for the presence of debris therein, and the filtering device is inserted in the chamber so as to be accessible to an operator of the apparatus at the port in the relatively upper casing member.

18. The annular metal casting unit according to claim 1 wherein the relatively upper casing member has means thereon for extracting a portion of the coolant flow from between the inlet and the outlet.

19. The annular metal casting unit according to claim 1 wherein the relatively upper casing member has means thereon for controlling the rate of flow between the inlet and the outlet.

20. The annular metal casting unit according to claim 1 wherein the relatively upper casing member has a port therein which opens into the chamber, the port has a plug inserted therein, the plug has a filtering device thereon which is suspended in the chamber between the inlet and the outlet, and the plug is removable from the port to remove the filtering device.

21. The annular metal casting unit according to claim 20 further comprising means on the relatively upper casing member for indicating when debris has accumulated on the filtering device to the extent that the backpressure in the chamber is undesirable.

22. The annular metal casting unit according to claim 1 wherein the mold has a source of pressurized fluid thereon, the joint has a circumferentially extending fluid flow passage therein for transmitting the fluid between the faces of the casing means, and the metal casting unit further comprises means whereby the fluid in the passage is discharged from the mold to a point on the outside thereof.

23. The annular metal casting unit according to claim 22 wherein the fluid discharge means are operable to discharge the fluid from the passage to the inner periphery of the joint.

24. The annular metal casting unit according to claim 22 wherein the passage is operable to circulate the fluid about the axis of the mold to a plurality of circumferentially spaced sites in the joint, and the fluid discharge means are operable to discharge the fluid from the respective sites.

25. The annular metal casting unit according to claim 24 further comprising a plurality of fluid operated devices that are suspended from the mold for use in aligning the mold with a stool during a stage preliminary to the casting operation, the fluid discharge means being operable to discharge the fluid from the respective sites in the joint to the plurality of fluid operated devices for the operation thereof.

26. The annular metal casting unit according to claim 24 wherein the mold body has a plurality of gas permeable wall segments arrayed about the inner periphery thereof, and the fluid discharge means are operable to discharge the fluid from the respective sites in the joint to the plurality of gas permeable wall segments to form an annulus of gas thereadjacent.

27. The annular metal casting unit according to claim 22 wherein the joint has a pair of first and second circumferentially extending fluid flow passages therein which are spaced apart from one another transverse the axis of the mold, the first passage is operable to circulate the fluid about the axis of the mold to a plurality of circumferentially spaced sites in the joint, and the fluid discharge means are operable to discharge the fluid from the respective sites to the inner periphery of the joint through the second passage.

28. The annular metal casting unit according to claim 22 wherein the passage is formed at an axially extending step in the joint, lying between a pair of spaced parallel planes transverse the axis of the mold, and the fluid discharge means are operable to discharge the fluid from the passage at the space between the planes before the fluid can enter the cavity at the inner periphery of the joint.

29. The annular metal casting unit according to claim 22 wherein the fluid discharge means take the form of an annular slit which is circumposed about the axis between the faces of the casing means at the inner periphery of the joint, and a ring of porous, fluid permeable material which is interposed in the joint between the passage and the slit to discharge the fluid into the cavity through the slit.

30. The annular metal casting unit according to claim 22 wherein the fluid discharge means take the form of a ring of porous, fluid permeable material which and is circumposed about the axis at the inner periphery of the joint, with the fluid transmission passage interposed between the annular ends thereof, to discharge the fluid into the cavity through the body thereof.

31. The annular metal casting unit according to claim 30 wherein the passage has branches thereof which extend within the body of the ring axially of the mold, to distribute the fluid more fully within the ring.

32. The annular metal casting unit according to claim 22 wherein the opposing faces of the casing means have a pair of surfaces thereon which extend about the axis of the mold opposite an annulus of the joint therebetween, the surface on the face of one of the casing means has a groove therein which extends about the annulus to form a recess between the bottom of the groove and the surface on the face of the other casing means, the source of pressurized fluid is connected with the bottom portion of the groove, to charge the groove with fluid, but the groove has a closure member seated in the top portion thereof at the joint, to form a circumferentially extending fluid flow passage in the bottom portion of the groove, and control the leakage of fluid from the passage.

33. The annular metal casting unit according to claim 32 wherein the closure member comprises a fluid permeable material which is operable to discharge the fluid from the passage at the inner periphery of the joint.

34. The annular metal casting unit according to claim 22 wherein the closure member is a fluid impermeable material, but the groove defining surface portion of the one casing means comprises a fluid permeable material which is operable to discharge the fluid from the passage at the inner periphery of the joint.

35. The annular metal casting unit according to claim 22 wherein the source of pressurized fluid is formed on the relatively upper casing member.

36. The annular metal casting unit according to claim 35 wherein the source of pressurized fluid is formed on the outer peripheral edge of the flange.

37. The annular metal casting unit according to claim 22 wherein the joint has an axially extending step therein between the sump and the inner periphery of the joint, the passage is interposed between the axial extending surfaces of the step, and the fluid discharge means operate to discharge any liquid coolant which leaks into the passage from the chamber, to an outlet for the leakage coolant on the outside of the mold, before the leakage coolant can reach the inner periphery of the joint.

38. The annular metal casting unit according to claim 37 wherein the outlet for the leakage coolant is formed on the relatively upper casing member.

39. The annular metal casting unit according to claim 38 wherein the outlet for the leakage coolant is formed on the outer peripheral edge of the flange.

40. The annular metal casting unit according to claim 1 wherein the mold cavity has an angulated outline at the bore thereof.

41. The annular metal casting unit according to claim 1 wherein the chamber has relatively inner and outer peripheral walls circumposed about the axis of the mold, and the unit further comprises means in the chamber adjacent the relatively inner peripheral wall thereof for metering the flow of liquid coolant between the inlet and the outlet for the mold body.

42. The annular metal casting unit according to claim 41 wherein the liquid coolant metering means include an annular baffle which is circumposed about the axis in the chamber to subdivide the chamber into relatively inner and outer peripheral portions, the inlet opens into the relatively outer peripheral portion of the chamber, the outlet opens from the relatively inner peripheral portion of the chamber, and the baffle is apertured to meter the flow of liquid coolant from the outer peripheral portion of the chamber to the inner peripheral portion thereof.

43. The annular metal casting unit according to claim 42 further comprising means on the baffle for infusing the coolant with gas as the coolant flows through the inner peripheral portion of the chamber.

44. The annular metal casting unit according to claim 43 further comprising a source of the infusion gas in the relatively upper casing member, and fluid transmission means suspended from the relatively upper casing member, which are operatively interconnected between the source and the gas infusion means on the baffle, to transport gas thereto.

45. The annular metal casting unit according to claim 44 wherein the baffle, the gas infusion means, and the fluid transmission means, ar suspended from the relatively upper casing member to quickly connect and disconnect with and from the relatively lower casing member across the joint therebetween, when the relatively upper casing member is engaged and disengaged with and from the relatively lower casing member in the assembly and disassembly of the mold body.

46. The annular metal casting unit according to claim 1 wherein the relatively lower casing member also defines the lower end of the mold body.

47. The annular metal casting unit according to claim 46 wherein the inlet for the liquid coolant is formed in the lower end of the relatively lower casing member.

48. The annular metal casting unit according to claim 1 further comprising means suspended from the lower end of the mold body for aligning the mold with a stool arranged below the bore of the table, to be telescopically engaged in the bottom of the bore.

49. An annular metal casting unit of the type which is operatively supported in an aperture in a metal casting table of a molten metal casting apparatus, so as to form an open ended bore therein through which the molten metal to be cast in the casting operation, is poured along a vertical axis of the table and cast into a molten metal body that progressively elongates along the axis as it emerges from the bottom of the bore, and wherein during the casting operation, a liquid coolant is discharged onto the molten metal body as it emerges from the bottom of the bore, to direct cool the metal therein, comprising:

an annular mold having a vertical axis and an annular body circumposed thereabout, which has upper and lower annular ends thereon, relatively inner and outer annular peripheries thereabout, and a bore therethrough, the cavity of which is formed about the axis of the mold and opens into the ends of the mold body so that the bore of the mold body can form the bore of the table when the unit is supported in the aperture of the table coaxially thereof, the mold body also having an inlet and means circumposed about the axis of the mold adjacent the lower end opening of the cavity, which are connected to the inlet and define an outlet whereby liquid coolant can be charged into the mold body through the inlet and then discharged from the outlet to direct cool the molten metal body emerging from the cavity at the lower end opening thereof, the mold body comprising a pair of relatively upper and lower casing means which are annular, circumposed about the axis of the mold, and superposed on one another so as to have mutually opposing faces thereon which are engaged with one another about the axis to form an annular joint therebetween, the casing means comprising a pair of relatively upper and lower casing members which are annular, circumposed about the axis, and engaged with one another at the joint to define the upper and lower end portions of the mold body at the outer periphery thereof, respectively, the relatively lower casing member defining the lower end opening of the cavity at the inner periphery of the mold body, the outlet for the coolant discharge, and the connection between the inlet and the outlet, the relatively upper casing member projecting relatively radially outwardly of the axis from the joint between the casing means, to form a flange on the body of the mold which overhangs the relatively lower casing member on opposite sides of the mold, and is operable to engage the top of the table to provide support for the metal casting unit when the unit is inserted in the aperture of the table from above the table, the relatively lower casing member having an annular sump therein which is circumposed about the axis of the mold at the joint, and in the connection between the inlet and the outlet, the relatively upper casing member covering the sump to form an annular chamber between the inlet and the outlet for the retention of liquid coolant in the mold body during the casting operation, the mold having an annular baffle therein which is circumposed about the axis in the chamber and apertured to meter the liquid coolant between the outer and inner peripheral portions of the chamber, the baffle having means thereon for infusing the coolant with gas as the coolant flows through the inner peripheral portion of the chamber, and the relatively upper casing member having a source therein for the infusion gas, and fluid transmission means suspended therefrom, which are operatively interconnected between the source and the gas infusion means on the baffle, to transport gas thereto.

50. The annular metal casting unit according to claim 49 wherein the baffle, the gas infusion means, and the fluid transmission means, are suspended from the relatively upper casing member to quickly connect and disconnect with and from the relatively lower casing member across the joint therebetween, when the upper casing member is engaged and disengaged with and from the relatively lower casing member in the assembly and disassembly of the mold body.

51. An annular metal casting unit of the type which is operatively supported in an aperture in a metal casting table of a molten metal casting apparatus, so as to form an open ended bore therein through which the molten metal to be cast in the casting operation, is poured along a vertical axis of the table and cast into a molten metal body that progressively elongates along the axis as it emerges from the bottom of the bore, and wherein during the casting operation, a liquid coolant is discharged onto the molten metal body as it emerges from the bottom of the bore, to direct cool the metal therein, comprising:

an annular mold having a vertical axis and an annular body circumposed thereabout, which has upper and lower annular ends thereon, relatively inner and outer annular peripheries thereabout, and a bore therethrough, the cavity of which is formed about the axis of the mold and opens into the ends of the mold body so that the bore of the mold body can form the bore of the table when the unit is supported in the aperture of the table coaxially thereof, the mold body also having an inlet and means circumposed about the axis of the mold adjacent the lower end opening of the cavity, which are connected to the inlet and define an outlet whereby liquid coolant can be charged into the mold body through the inlet and then discharged from the outlet to direct cool the molten metal body emerging from the cavity at the lower end opening thereof, the mold body comprising a pair of relatively upper and lower casing means which are annular, circumposed about the axis of the mold, and superposed on one another so as to have mutually opposing faces thereon which are engaged with one another about the axis to form an annular joint therebetween, the casing means comprising a pair of relatively upper and lower casing members which are annular, circumposed about the axis, and engaged with one another at the joint to define the upper and lower end portions of the mold body at the outer periphery thereof, respectively, the relatively lower casing member defining the lower end opening of the cavity at the inner periphery of the mold body, the outlet for the coolant discharge, and the connection between the inlet and the outlet, the relatively upper casing member projecting relatively radially outwardly of the axis from the joint between the casing means, to form a flange on the body of the mold which overhangs the relatively lower casing member on opposite sides of the mold, and is operable to engage the top of the table to provide support for the metal casting unit when the unit is inserted in the aperture of the table from above the table, and a device for monitoring the liquid coolant flow in the connection between the inlet and the outlet, the monitoring device being mounted on the relatively upper casing member so as to be inserted in the connection between the inlet and the outlet.

52. The annular metal casting unit according to claim 51 wherein the mold body has a chamber in the connection between the inlet and the outlet, and the monitoring device is suspended in the chamber on the relatively upper casing member.

53. An annular metal casting unit of the type which is operatively supported in an aperture in a metal casting table of a molten metal casting apparatus, so as to form an open ended bore therein through which the molten metal to be cast in the casting operation, is poured along a vertical axis of the table and cast into a molten metal body that progressively elongates along the axis as it emerges from the bottom of the bore, and wherein during the casting operation, a liquid coolant is discharged onto the molten metal body as it emerges from the bottom of the bore, to direct cool the metal therein, comprising:

an annular mold having a vertical axis and an annular body circumposed thereabout, which has upper and lower annular ends thereon, relatively inner and outer annular peripheries thereabout, and a bore therethrough, the cavity of which is formed about the axis of the mold and opens into the ends of the mold body so that the bore of the mold body can form the bore of the table when the unit is supported in the aperture of the table coaxially thereof, the mold body also having an inlet and means circumposed about the axis of the mold adjacent the lower end opening of the cavity, which are connected to the inlet and define an outlet whereby liquid coolant can be charged into the mold body through the inlet and then discharged from the outlet to direct cool the molten metal body emerging from the cavity at the lower end opening thereof, the mold body comprising a pair of relatively upper and lower casing means which are annular, circumposed about the axis of the mold, and superposed on one another so as to have mutually opposing faces thereon which are engaged with one another about the axis to form an annular joint therebetween, the casing means comprising a pair of relatively upper and lower casing members which are annular, circumposed about the axis, and engaged with one another at the joint to define the upper and lower end portions of the mold body at the outer periphery thereof, respectively, the relatively lower casing member defining the lower end opening of the cavity at the inner periphery of the mold body, the outlet for the coolant discharge, and the connection between the inlet and the outlet, the relatively upper casing member projecting relatively radially outwardly of the axis from the joint between the casing means, to form a flange on the body of the mold which overhangs the relatively lower casing member on opposite sides of the mold, and is operable to engage the top of the table to provide support for the metal casting unit when the unit is inserted in the aperture of the table from above the table, and the mold body having means therein which are operatively interposed between the inlet and the outlet to monitor the coolant flow in the connection therebetween during the casting operation, and the relatively upper casing member having a port therein for access to the monitoring means.

54. The annular metal casting unit according to claim 53 wherein the mold body has a chamber in the connection between the inlet and the outlet, the monitoring means include a device for filtering the flow of coolant through the chamber, for the presence of debris therein, and the filtering device is inserted in the chamber so as to be accessible to an operator of the apparatus at the port in the relatively upper casing member.

55. An annular metal casting unit of the type which is operatively supported in an aperture in a metal casting table of a molten metal casting apparatus, so as to form an open ended bore therein through which the molten metal to be cast in the casting operation, is poured along a vertical axis of the table and cast into a molten metal body that progressively elongates along the axis as it emerges from the bottom of the bore, and wherein during the casting operation, a liquid coolant is discharged onto the molten metal body as it emerges from the bottom of the bore, to direct cool the metal therein, comprising:

an annular mold having a vertical axis and an annular body circumposed thereabout, which has upper and lower annular ends thereon, relatively inner and outer annular peripheries thereabout, and a bore therethrough, the cavity of which is formed about the axis of the mold and opens into the ends of the mold body so that the bore of the mold body can form the bore of the table when the unit is supported in the aperture of the table coaxially thereof, the mold body also having an inlet and means circumposed about the axis of the mold adjacent the lower end opening of the cavity, which are connected to the inlet and define an outlet whereby liquid coolant can be charged into the mold body through the inlet and then discharged from the outlet to direct cool the molten metal body emerging from the cavity at the lower end opening thereof, the mold body comprising a pair of relatively upper and lower casing means which are annular, circumposed about the axis of the mold, and superposed on one another so as to have mutually opposing faces thereon which are engaged with one another about the axis to form an annular joint therebetween, the casing means comprising a pair of relatively upper and lower casing members which are annular, circumposed about the axis, and engaged with one another at the joint to define the upper and lower end portions of the mold body at the outer periphery thereof, respectively, the relatively lower casing member defining the lower end opening of the cavity at the inner periphery of the mold body, the outlet for the coolant discharge, and the connection between the inlet and the outlet, the relatively upper casing member projecting relatively radially outwardly of the axis from the joint between the casing means, to form a flange on the body of the mold which overhangs the relatively lower casing member on opposite sides of the mold, and is operable to engage the top of the table to provide support for the metal casting unit when the unit is inserted in the aperture of the table from above the table, and the mold body having a chamber in the connection between the inlet and the outlet, the relatively upper casing member having a port therein which opens into the chamber, the port having a plug inserted therein, the plug having a filtering device thereon which is suspended in the chamber between the inlet and the outlet, and the plug being removable from the port to remove the filtering device.

56. The annular metal casting unit according to claim 55 further comprising means on the relatively upper casing member for indicating when debris has accumulated on the filtering device to the extent that the back pressure in the connection is undesirable.

57. An annular metal casting unit of the type which is operatively supported in an aperture in a metal casting table of a molten metal casting apparatus, so as to form an open ended bore therein through which the molten metal to be cast in the casting operation, is poured along a vertical axis of the table and cast into a molten metal body that progressively elongates along the axis as it emerges from the bottom of the bore, and wherein during the casting operation, a liquid coolant is discharged onto the molten metal body as it emerges from the bottom of the bore, to direct cool the metal therein, comprising:

an annular mold having a vertical axis and an annular body circumposed thereabout, which has upper and lower annular ends thereon, relatively inner and outer annular peripheries thereabout, and a bore therethrough, the cavity of which is formed about the axis of the mold and opens into the ends of the mold body so that the bore of the mold body can form the bore of the table when the unit is supported in the aperture of the table coaxially thereof, the mold body also having an inlet and means circumposed about the axis of the mold adjacent the lower end opening of the cavity, which are connected to the inlet and define an outlet whereby liquid coolant can be charged into the mold body through the inlet and then discharged from the outlet to direct cool the molten metal body emerging from the cavity at the lower end opening thereof, the mold body comprising a pair of relatively upper and lower casing means which are annular, circumposed about the axis of the mold, and superposed on one another so as to have mutually opposing faces thereon which are engaged with one another about the axis to form an annular joint therebetween, the casing means comprising a pair of relatively upper and lower casing members which are annular, circumposed about the axis, and engaged with one another at the joint to define the upper and lower end portions of the mold body at the outer periphery thereof, respectively, the relatively lower casing member defining the lower end opening of the cavity at the inner periphery of the mold body, the outlet for the coolant discharge, and the connection between the inlet and the outlet, the relatively upper casing member projecting relatively radially outwardly of the axis from the joint between the casing means, to form a flange on the body of the mold which overhangs the relatively lower casing member on opposite sides of the mold, and is operable to engage the top of the table to provide support for the metal casting unit when the unit is inserted in the aperture of the table from above the table, and the mold having a source of pressurized fluid thereon, the joint having a circumferentially extending fluid flow passage therein for transmitting the fluid between the faces of the casing means, and the metal casting unit further comprising means whereby the fluid in the passage is discharged from the mold to a point on the outside thereof, the passage being operable to circulate the fluid about the axis of the mold to a plurality of circumferentially spaced sites in the joint, and the fluid discharge means being operable to discharge the fluid from the respective sites, the metal casting unit further comprising a plurality of fluid operated devices that are suspended from the mold for use in aligning the mold and a stool with one another on the axis of the table during a preliminary stage to the casting operation, and the fluid discharge means being operable to discharge the fluid from the respective sites in the joint to the plurality of fluid operated devices for the operation thereof.

58. An annular metal casting unit of the type which is operatively supported in an aperture in a metal casting table of a molten metal casting apparatus, so as to form an open ended bore therein through which the molten metal to be cast in the casting operation, is poured along a vertical axis of the table and cast into a molten metal body that progressively elongates along the axis as it emerges from the bottom of the bore, and wherein during the casting operation, a liquid coolant is discharged onto the molten metal body as it emerges from the bottom of the bore, to direct cool the metal therein, comprising:

an annular mold having a vertical axis and an annular body circumposed thereabout, which has upper and lower annular ends thereon, relatively inner and outer annular peripheries thereabout, and a bore therethrough, the cavity of which is formed about the axis of the mold and opens into the ends of the mold body so that the bore of the mold body can form the bore of the table when the unit is supported in the aperture of the table coaxially thereof, the mold body also having an inlet and means circumposed about the axis of the mold adjacent the lower end opening of the cavity, which are connected to the inlet and define an outlet whereby liquid coolant can be charged into the mold body through the inlet and then discharged from the outlet to direct cool the molten metal body emerging from the cavity at the lower end opening thereof, the mold body comprising a pair of relatively upper and lower casing means which are annular, circumposed about the axis of the mold, and superposed on one another so as to have mutually opposing faces thereon which are engaged with one another about the axis to form an annular joint therebetween, the casing means comprising a pair of relatively upper and lower casing members which are annular, circumposed about the axis, and engaged with one another at the joint to define the upper and lower end portions of the mold body at the outer periphery thereof, respectively, the relatively lower casing member defining the lower end opening of the cavity at the inner periphery of the mold body, the outlet for the coolant discharge, and the connection between the inlet and the outlet, the relatively upper casing member projecting relatively radially outwardly of the axis from the joint between the casing means, to form a flange on the body of the mold which overhangs the relatively lower casing member on opposite sides of the mold, and is operable to engage the top of the table to provide support for the metal casting unit when the unit is inserted in the aperture of the table from above the table, and the mold having a source of pressurized fluid thereon, the joint having a circumferentially extending fluid flow passage therein for transmitting the fluid between the faces of the casing means, and the metal casting unit further comprising means whereby the fluid in the passage is discharged from the mold to a point on the outside thereof, the relatively lower casing member having an annular sump therein which is circumposed about the axis of the mold at the joint and covered by the relatively upper casing member to form an annular chamber in the mold body, the joint having an axially extending step therein between the sump and the inner periphery of the joint, the passage being interposed between the axial extending surfaces of the step, and the fluid discharge means operating to discharge any liquid coolant which leaks into the passage from the chamber, to an outlet for the leakage coolant on the outside of the mold, before the leakage coolant can reach the inner periphery of the joint.

59. The annular metal casting unit according to claim 58 wherein the outlet for the leakage coolant is formed on the relatively upper casing member.

60. The annular metal casting unit according to claim 59 wherein the outlet for the leakage coolant is formed on the outer peripheral edge of the flange.

* * * * *

UNITED STATES PATENT AND TRADEMARK OFFICE

CERTIFICATE OF CORRECTION

PATENT NO. : 5,323,841

DATED : June 28, 1994

INVENTOR(S) : Frank E. Wagstaff; Robert B. Wagstaff; David A. Fort; Richard J. Collins It is certified that error appears in the above-identified patent and that said Letters Patent is hereby corrected as shown below:

Column 20, line 44 thereof, change "are" to --have--

Column 22, line 44 thereof, delete "from"

Column 23, line 54 thereof, delete "and"

Column 23, line 57 thereof, delete "annular"

Column 24, line 50 thereof, change "for" to --of--

Column 25, line 7 thereof, change "ar" to --are--

Column 28, line 32 thereof, delete "and"

Column 30, line 38 thereof, delete "and"

Column 32, line 11 thereof, delete "and"

Signed and Sealed this

Thirteenth Day of December, 1994

*Attest:*

Bruce Lehman

BRUCE LEHMAN

*Attesting Officer*

*Commissioner of Patents and Trademarks*